US009418670B2

(12) United States Patent
Matsumura et al.

(10) Patent No.: US 9,418,670 B2
(45) **Date of Patent: *Aug. 16, 2016**

(54) ENCODING APPARATUS, ENCODING METHOD, AND PROGRAM

(71) Applicant: SONY CORPORATION, Tokyo (JP)

(72) Inventors: Yuuki Matsumura, Saitama (JP); Shiro Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/724,077

(22) Filed: May 28, 2015

(65) Prior Publication Data

US 2015/0262585 A1 Sep. 17, 2015

Related U.S. Application Data

(63) Continuation of application No. 13/285,310, filed on Oct. 31, 2011, now Pat. No. 9,076,432.

(30) Foreign Application Priority Data

Nov. 9, 2010 (JP) ..... 2010-250614

(51) Int. Cl.
*G10L 19/14* (2006.01)
*G10L 19/028* (2013.01)
(Continued)

(52) U.S. Cl.
CPC ..... *G10L 19/028* (2013.01); *G10L 19/002* (2013.01); *G10L 19/0204* (2013.01); *G10L 19/0212* (2013.01)

(58) Field of Classification Search
CPC ... G01L 21/0208; G01L 21/038; G01L 13/00; G01L 15/26; G01L 15/265; G01L 19/0208; G01L 2021/065; G01L 25/69; G01L 25/90; G01L 25/78; G01L 19/012; G01L 19/0204; G01L 19/07; G01L 2021/02165; G01L 21/0216; G01L 21/0232; G01L 15/00; G01L 2021/02161; G01L 21/0364; G10K 2210/3028; G10K 11/1784; G10K 11/1786; G10K 11/1788; G10K 15/02; G10K 2210/3044; G10K 2210/3051; G10K 2210/3213
USPC ..... 704/500–504, 222, 226–230, 205
See application file for complete search history.

(56) References Cited

U.S. PATENT DOCUMENTS 5,642,383 A 6/1997 Suzuki
6,098,039 A * 8/2000 Nishida ..... G10L 19/0208 704/229
2006/0178876 A1 8/2006 Sato et al.
2006/0241938 A1 10/2006 Hetherington et al.
(Continued)

FOREIGN PATENT DOCUMENTS

CN 101010727 A 8/2007
CN 101030382 A 9/2007
(Continued)

OTHER PUBLICATIONS

Apr. 16, 2015, Chinese Office Action for related CN application No. 201110342537.2.
(Continued)

*Primary Examiner* — Huyen Vo
(74) *Attorney, Agent, or Firm* — Paratus Law Group, PLLC

(57) ABSTRACT

An encoding apparatus includes a noise detector configured to detect noise included in a certain band in accordance with an audio signal, a gain controller configured to perform gain control on the audio signal so that components in the certain band of the audio signal are attenuated when the noise is detected by the noise detector, a bit allocation calculation unit configured to calculate the numbers of bits to be allocated to frequency spectra of the audio signal which have been subjected to the gain control performed by the gain controller in accordance with the frequency spectra, and a quantization unit configured to quantize the frequency spectra of the audio signal which have been subjected to the gain control in accordance with the numbers of the bits.

3 Claims, 32 Drawing Sheets

(51) Int. Cl.
*G10L 19/002* (2013.01)
*G10L 19/02* (2013.01)

(56) References Cited

U.S. PATENT DOCUMENTS

2007/0174050 A1* 7/2007 Li ..... G10L 21/02 704/208
2008/0015855 A1 1/2008 Suzuki

FOREIGN PATENT DOCUMENTS

EP 1768104 A1 3/2007
JP 2006-011170 1/2006

OTHER PUBLICATIONS

Apr. 16, 2015, CN communication issued for related CN application No. 201110342537.2.

* cited by examiner

FIG. 7

| idsf | ... | 14 | 15 | 16 | 17 | 18 | ... | 30 | 31 |
|---|---|---|---|---|---|---|---|---|---|
| sf(idsf) | ... | 1/2 | 1 | 2 | 4 | 8 | ... | 32768 | 65536 |

ENCODING APPARATUS, ENCODING METHOD, AND PROGRAM

CROSS REFERENCE TO PRIOR APPLICATION

This application is a continuation of U.S. patent application Ser. No. 13/285,310 (filed on Oct. 31, 2011), which claims priority to Japanese Patent Application No. 2010-250614 (filed on Nov. 9, 2010), which are all hereby incorporated by reference in their entirety.

BACKGROUND

The present disclosure relates to encoding apparatuses, encoding methods, and programs, and particularly relates to an encoding apparatus, an encoding method, and a program which are capable of accurately encoding an audio signal including noise in a certain band.

In general, examples of a method for encoding an audio signal include a method for performing normalization and quantization on frequency spectra obtained by performing time-frequency transform on an audio signal (refer to Japanese Unexamined Patent Application Publication No. 2006-11170, for example).

FIG. 1 is a block diagram illustrating a configuration of an audio encoding apparatus which performs encoding in such an encoding method.

An audio encoding apparatus 10 shown in FIG. 1 includes a time-frequency transform unit 11, a normalization unit 12, a bit allocation calculation unit 13, a quantization unit 14, and a code-string encoder 15. The audio encoding apparatus 10 encodes an audio signal input as a time-series signal and outputs a code string.

Specifically, the time-frequency transform unit 11 included in the audio encoding apparatus 10 performs time-frequency transform on an audio signal input as a time-series signal and outputs frequency spectra mdspec. For example, the time-frequency transform unit 11 performs time-frequency transform on a time-series signal of 2N samples using orthogonal transform such as MDCT (Modified Discrete Cosine Transform) and outputs N MDCT coefficients obtained as a result of the time-frequency transform as the frequency spectra mdspec.

The normalization unit 12 performs normalization on the frequency spectra mdspec supplied from the time-frequency transform unit 11 for each predetermined processing unit using normalization coefficients obtained in accordance with amplitudes of the frequency spectra mdspec. The normalization unit 12 outputs normalization information idsf which is information on integer numbers corresponding to the normalization coefficients and normalization frequency spectra nspec obtained by normalizing the frequency spectra mdspec.

The bit allocation calculation unit 13 performs bit allocation calculation such that the numbers of bits to be allocated to the normalization frequency spectra nspec are calculated for each predetermined processing unit in accordance with the normalization information idsf supplied from the normalization unit 12 so as to output quantization information idwl representing the numbers of bits. Furthermore, the bit allocation calculation unit 13 outputs the normalization information idsf supplied from the normalization unit 12.

The quantization unit 14 quantizes the normalization frequency spectra nspec supplied from the normalization unit 12 in accordance with the quantization information idwl supplied from the bit allocation calculation unit 13. Specifically, the quantization unit 14 quantizes the normalization frequency spectra nspec for each predetermined processing unit using quantization coefficients corresponding to the quantization information idwl. The quantization unit 14 outputs a quantization frequency spectra qspec as a result of the quantization.

The code-string encoder 15 encodes the normalization information idsf and the quantization information idwl which are supplied from the bit allocation calculation unit 13 and the frequency spectra qspec supplied from the quantization unit 14 and outputs a code string obtained as a result of the encoding. The output code string may be transmitted to another apparatus or may be recorded in a certain recording medium.

Furthermore, in recent years, an audio signal processed by audio encoding apparatuses is expanded from a PCM (Pulse Code Modulation) signal of a frequency of 44.1 kHz and a PCM word length of 16 bits and a PCM signal of a frequency of 48 kHz and a PCM word length of 16 bits to a PCM signal having high-quality multi bits such as a PCM signal of a frequency of 96 kHz and a PCM word length of 24 bits and a PCM signal of a frequency of 192 kHz and a PCM word length of 24 bits.

Such a high-quality multi-bit PCM signal is not generated as a multi-bit PCM signal from the beginning but is generated using a PDM (Pulse Density Modulation) signal such as a DSD (Direct Stream Digital) signal as a source in many cases.

This is because, in a field of an A/D converter used to convert an analog audio signal into a digital audio signal, a replacement of a successive-approximation A/D converter by a delta-sigma A/D converter has been rapidly progressed.

More specifically, a general successive-approximation A/D converter may directly generate a multi-bit PCM signal but conversion accuracy is considerably restricted by element accuracy. Therefore, when a PCM word length is equal to or larger than 24 bits, it is difficult to ensure linearity of the A/D conversion. On the other hand, in a delta-sigma A/D converter, A/D conversion is easily performed with high accuracy using a single threshold value. In view of such a background, as an A/D converter, the delta-sigma A/D converter has been widely used instead of the general successive-approximation A/D converter.

FIG. 2 is a diagram illustrating an input signal and an output signal of an 1-bit delta-sigma A/D converter. As shown in FIG. 2, in the 1-bit delta-sigma A/D converter, an analog audio signal serving as an input signal is converted into a 1-bit PDM signal which has amplitude represented by time density of +1 and which serves as an output signal.

FIG. 3 is a diagram illustrating quantization noise in the delta-sigma A/D converter. As shown in FIG. 3, first, in the delta-sigma A/D converter, the quantization noise included in an audio band (0 to fs/2 in the example shown in FIG. 3) is dispersed in a wide band (0 to nfs/2 in the example shown in FIG. 3) by performing oversampling. Next, the quantization noise is shifted out of the audio band by performing noise shaping. Accordingly, the delta-sigma A/D converter may realize a high S/N (signal/noise) ratio in the audio band.

As described above, when a source of a high-quality multi-bit PCM signal is a PDM signal obtained by the delta-sigma A/D converter, the multi-bit PCM signal is generated by performing a LPF (Low Pass Filter) process on the PDM signal.

The multi-bit PCM signal obtained as described above is represented as a delta-sigma type A as shown in FIG. 4. This quantization noise is undesired noise for the multi-bit PCM signal.

SUMMARY

However, in the audio encoding apparatus 10 shown in FIG. 1, since the bit allocation calculation is performed in accordance with normalization information idsf of an input audio signal, when the multi-bit PCM signal is input, a number of bits are allocated to normalization frequency spectra nspec out of the audio band which includes undesired quantization noise.

Accordingly, the number of bits which may be allocated to the normalization frequency spectra nspec in the audio band which is important in terms of acoustic sense is reduced and encoding accuracy is deteriorated. As a result, even if an audio signal to be subjected to encoding is a high-quality multi-bit PCM signal, it may be possible that an audio signal having high quality is not recorded and transmitted.

It is desirable to accurately encode an audio signal including noise in a certain band.

According to an embodiment of the present disclosure, there is provided an encoding apparatus includes a noise detector configured to detect noise included in a certain band in accordance with an audio signal, a gain controller configured to perform gain control on the audio signal so that components in the certain band of the audio signal are attenuated when the noise is detected by the noise detector, a bit allocation calculation unit configured to calculate the numbers of bits to be allocated to frequency spectra of the audio signal which have been subjected to the gain control performed by the gain controller in accordance with the frequency spectra, and a quantization unit configured to quantize the frequency spectra of the audio signal which have been subjected to the gain control in accordance with the numbers of the bits.

According to another embodiment of the present disclosure, there is provided an encoding method and a program corresponding to the encoding apparatus of the embodiment of the present disclosure.

According to a further embodiment of the present disclosure, noise included in a certain band is detected in accordance with an audio signal, gain control is performed on the audio signal so that components in the certain band of the audio signal are attenuated when the noise is detected by the noise detector, the numbers of bits to be allocated to frequency spectra of the audio signal which have been subjected to the gain control performed by the gain controller are calculated in accordance with the frequency spectra, and the frequency spectra of the audio signal which have been subjected to the gain control are quantized in accordance with the numbers of the bits.

The encoding apparatus according to the embodiment of the present disclosure may be independently provided or may be configured as an internal block of an apparatus.

Accordingly, an audio signal including noise in a certain band may be encoded with high accuracy.

BRIEF DESCRIPTION OF THE DRAWINGS

FIG. 7 is a diagram illustrating the relationships between normalization information and normalization coefficients;

DETAILED DESCRIPTION OF EMBODIMENTS

First Embodiment

Example of Configuration of Audio Encoding Apparatus of First Embodiment

Figure 5:
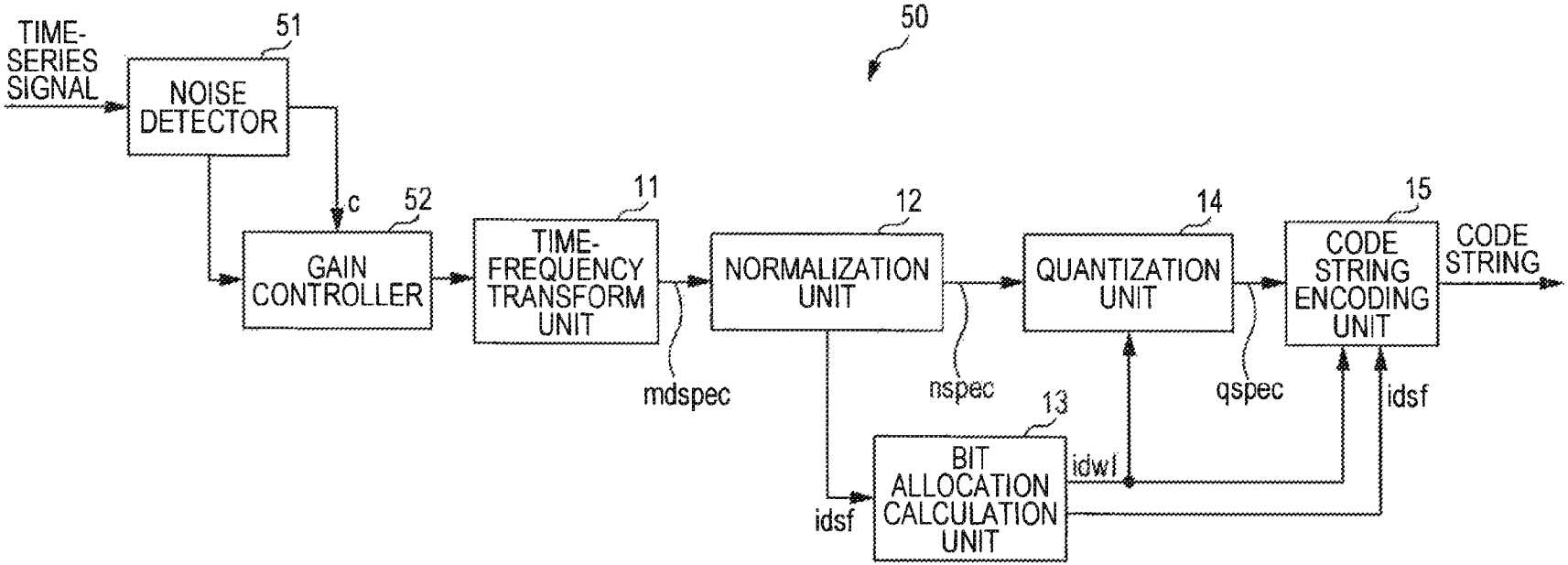
FIG. 5 is a block diagram illustrating a configuration of an audio encoding apparatus according to a first embodiment of the present disclosure.

FIG. 5 is a block diagram illustrating a configuration of an audio encoding apparatus according to a first embodiment of the present disclosure.

Figure 1:
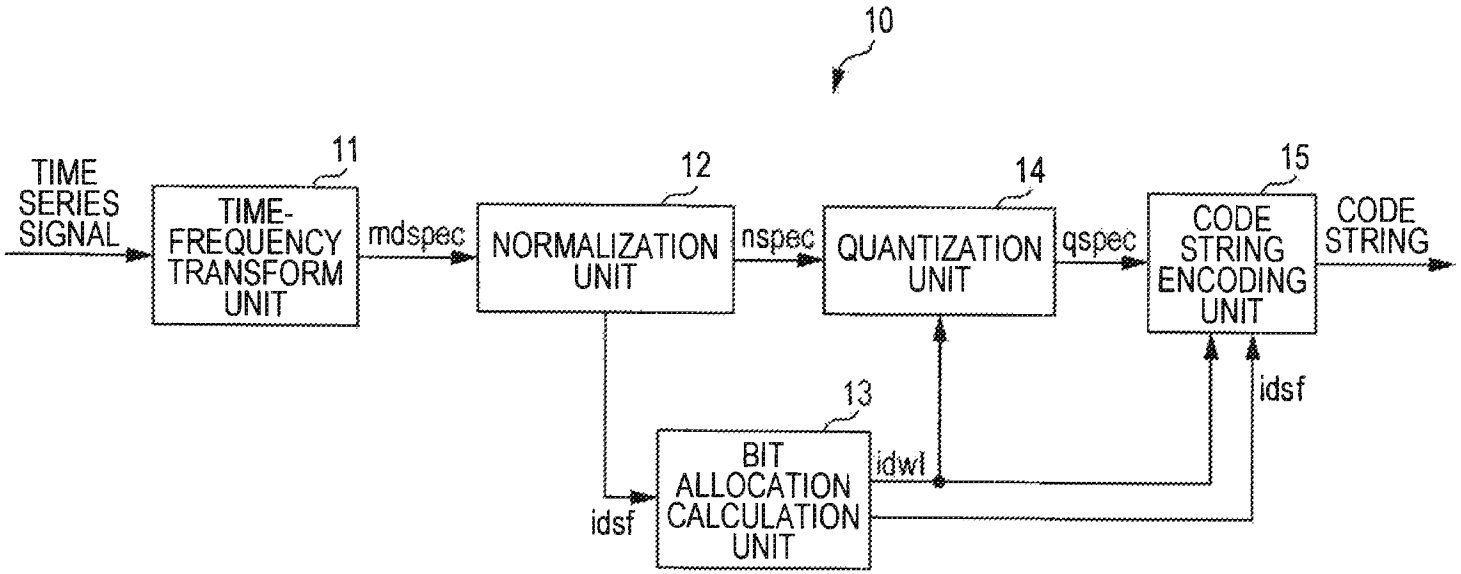
FIG. 1 is a block diagram illustrating a configuration of a general audio encoding apparatus.
Figure 2:
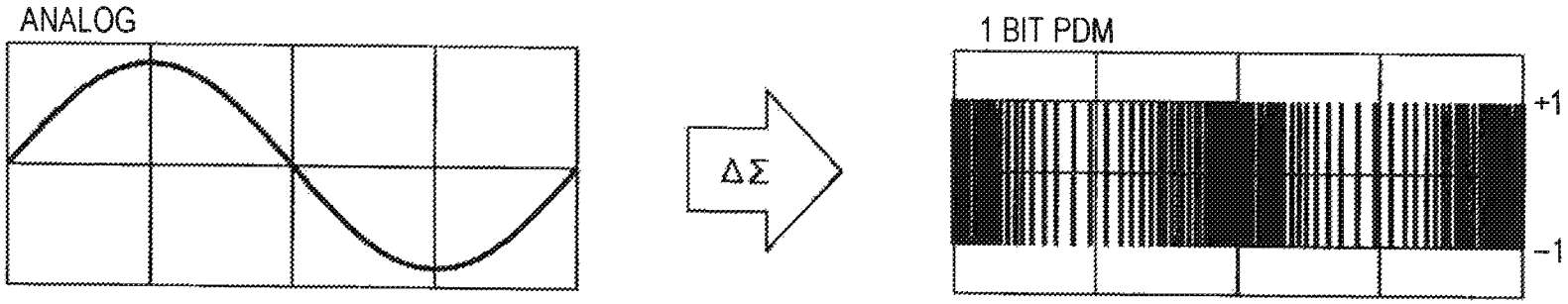
FIG. 2 is a diagram illustrating an input signal and an output signal of an 1-bit delta-sigma A/D converter.
Figure 3:
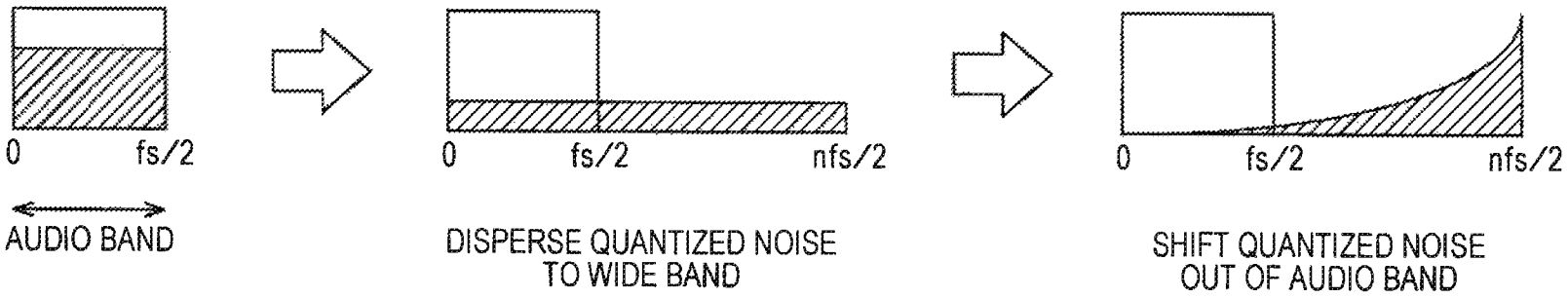
FIG. 3 is a diagram illustrating quantization noise in the delta-sigma A/D converter.
Figure 4:
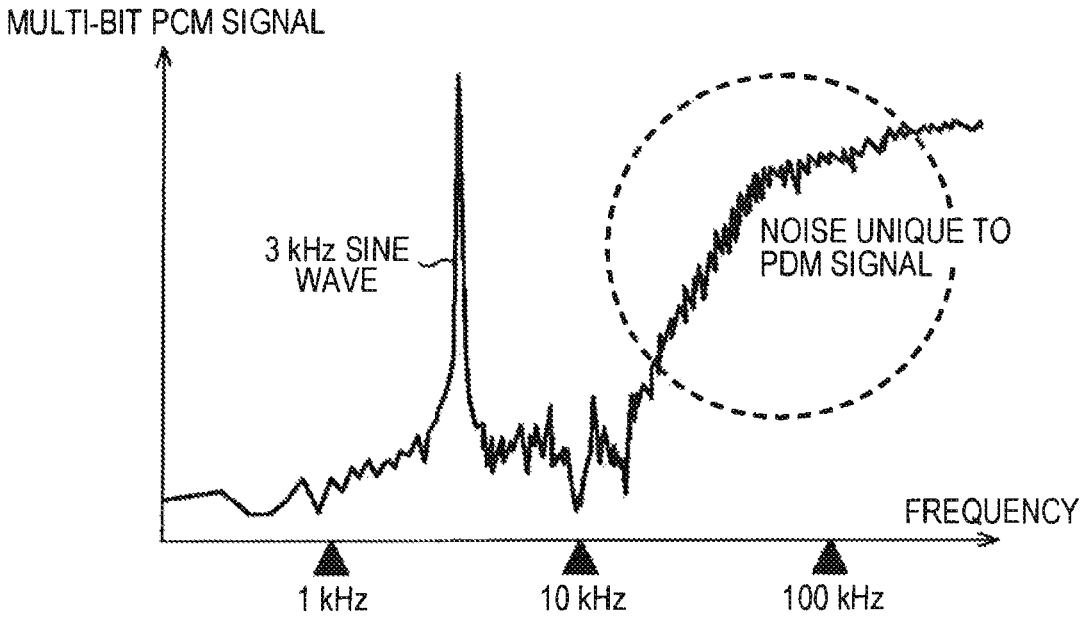
FIG. 4 is a diagram illustrating a multi-bit PCM signal.

In the configuration shown in FIG. 5, configurations the same as those shown in FIG. 1 are denoted by reference numerals the same as those shown in FIG. 1. Redundant descriptions are appropriately omitted.

The configuration of an audio encoding apparatus 50 shown in FIG. 5 is different from that shown in FIG. 1 in that a noise detector 51 and a gain controller 52 are disposed before a time-frequency transform unit 11. When detecting noise unique to a PDM signal in accordance with an input audio signal, the audio encoding apparatus 50 attenuates and encodes high-frequency components out of an audio band including the noise unique to a PDM signal.

Specifically, the noise detector 51 of the audio encoding apparatus 50 performs a noise detection process to detect the noise unique to a PDM signal in accordance with an audio signal input as a time-series signal and outputs a control signal c representing a result of the detection. Note that the noise unique to a PDM signal is quantization noise generated by a delta-sigma A/D converter. The noise is temporally continued in a high-frequency band out of the audio band, is comparatively large, and has a tendency of monotonic increase.

The gain controller 52 performs gain control on the audio signal input as the time-series signal in accordance with the control signal c supplied from the noise detector 51. Specifically, when the control signal c represents detection of noise, the gain controller 52 controls gain of the audio signal such that components in the high-frequency band out of the audio band of the audio signal attenuate and supplies a resultant audio signal to the time-frequency transform unit 11. On the other hand, when the control signal c represents that noise has not been detected, the gain controller 52 supplies the audio signal to the time-frequency transform unit 11 without change.

Configurations of Noise Detector and Gain Controller

Figure 6:
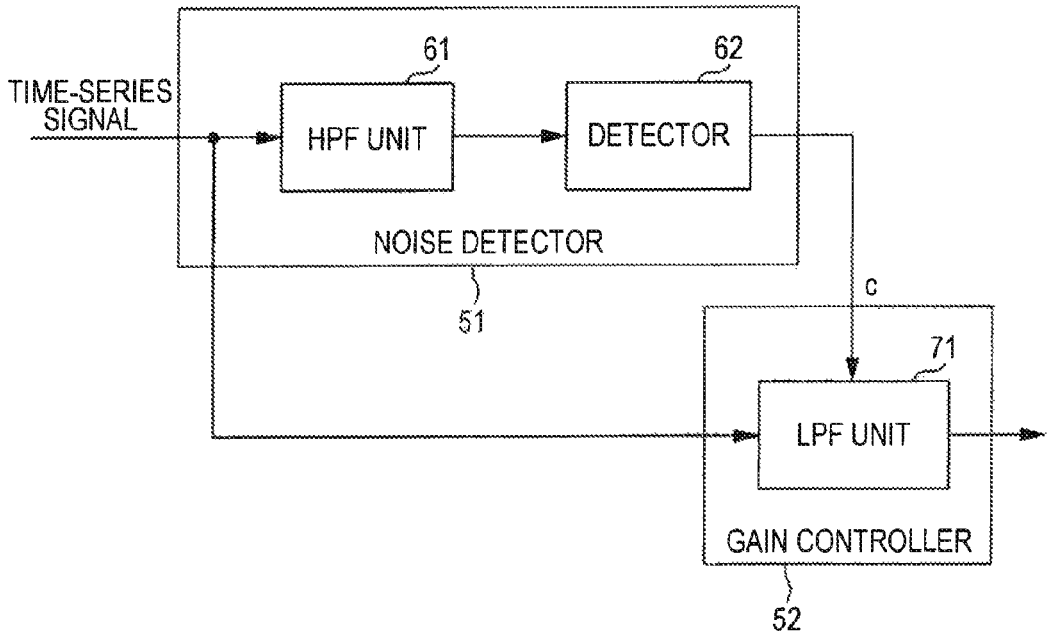
FIG. 6 is a block diagram illustrating a configuration of a noise detector and a gain controller in detail.

FIG. 6 is a block diagram illustrating configurations of the noise detector 51 and the gain controller 52 in detail.

The noise detector 51 shown in FIG. 6 includes an HPF (High Pass Filter) unit 61 and a detector 62, and the gain controller 52 includes an LPF unit 71. The noise detector 51 and the gain controller 52 shown in FIG. 6 perform the noise detection process and the gain control, respectively, on a time-region signal of an audio signal.

Specifically, the HPF unit 61 of the noise detector 51 shown in FIG. 6 performs the HPF process on the audio signal input as the time-series signal so as to extract and output high-frequency components out of the audio band of the audio signal.

The detector 62 performs the noise detection process in accordance with a power or the like of a high-frequency component out of the audio band of the audio signal supplied from the HPF unit 61 so as to output the control signal c. Specifically, when a power of a high-frequency component out of the audio band of the audio signal is equal to or larger than a threshold value, for example, the detector 62 outputs a control signal c representing detection of noise. On the other hand, when the power of the high-frequency component out of the audio band of the audio signal is smaller than the threshold value, the detector 62 outputs a control signal c representing that noise has not been detected.

When the control signal c represents detection of noise in accordance with the control signal c supplied from the detector 62, the LPF unit 71 of the gain controller 52 performs an LPF process on the audio signal so as to attenuate the high-frequency component out of the audio band of the audio signal. Then, the LPF unit 71 supplies the audio signal in which the high-frequency component out of the audio band is attenuated to the time-frequency transform unit 11. On the other hand, when the control signal c represents that noise has not been detected, the LPF unit 71 supplies the audio signal to the time-frequency transform unit 11 without change.

Relationship Between Normalization Information and Normalization Coefficients

FIG. 7 is a diagram illustrating the relationships between normalization information idsf and normalization coefficients sf(idsf).

As shown in FIG. 7, each of the normalization coefficients sf(idsf) is the power of two and the normalization information idsf is an integer number unique to each of the normalization coefficients.

Process of Audio Encoding Apparatus

Figure 8:
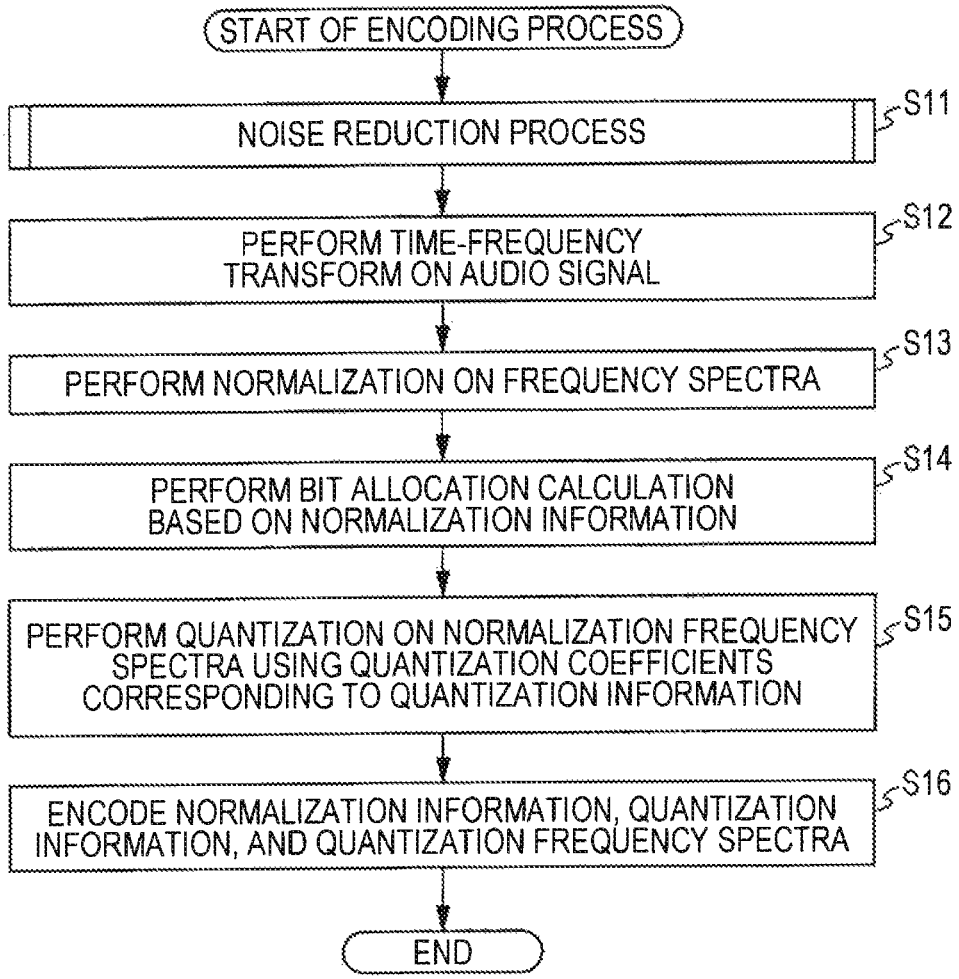
FIG. 8 is a flowchart illustrating an encoding process performed by the audio encoding apparatus shown in FIG. 5.

FIG. 8 is a flowchart illustrating an encoding process performed by the audio encoding apparatus 50 shown in FIG. 5. The encoding process is started when an audio signal which is a time-series signal is supplied to the audio encoding apparatus 50.

In step S11 of FIG. 8, the noise detector 51 and the gain controller 52 of the audio encoding apparatus 50 performs a noise reduction process to reduce noise unique to a PDM signal. The noise reduction process will be described in detail with reference to FIGS. 9 and 18 hereinafter.

In step S12, the time-frequency transform unit 11 performs time-frequency transform on the audio signal supplied from the gain controller 52 as a result of the noise reduction process performed in step S11 and outputs a resultant frequency spectra mdspec.

In step S13, the normalization unit 12 performs normalization on the frequency spectra mdspec supplied from the time-frequency transform unit 11 for each predetermined processing unit using normalization coefficients sf(idsf) obtained in accordance with amplitudes of the frequency spectra mdspec. The normalization unit 12 outputs normalization information idsf corresponding to the normalization coefficients sf(idsf) and normalization frequency spectra nspec.

In step S14, the bit allocation calculation unit 13 performs bit allocation calculation for each predetermined processing unit in accordance with the normalization information idsf supplied from the normalization unit 12 and outputs quantization information idwl. Furthermore, the bit allocation calculation unit 13 outputs the normalization information idsf supplied from the normalization unit 12.

In step S15, the quantization unit 14 performs quantization on the normalization frequency spectra nspec supplied from the normalization unit 12 for each processing unit using the quantization coefficients corresponding to the quantization information idwl supplied from the bit allocation calculation unit 13. The quantization unit 14 outputs quantization frequency spectra qspec obtained as a result of the quantization.

In step S16, the code-string encoder 15 encodes the normalization information idsf and the quantization information idwl which are supplied from the bit allocation calculation unit 13 and the frequency spectra qspec output from the quantization unit 14 and outputs a code string obtained as a result of the encoding. Then, the process is terminated.

Figure 9:
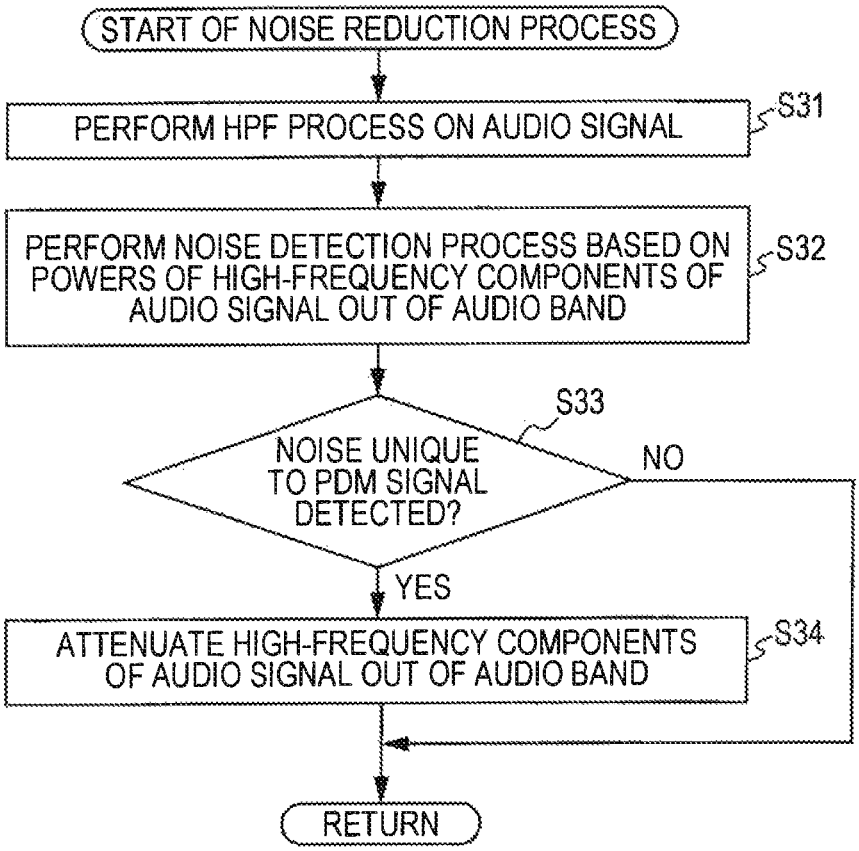
FIG. 9 is a flowchart illustrating a noise reduction process shown in FIG. 8.

FIG. 9 is a flowchart illustrating the noise reduction process performed in step S11 of FIG. 8.

In step S31 of FIG. 9, the HPF unit 61 of the noise detector 51 shown in FIG. 6 performs an HPF process on an audio signal input as a time-series signal so as to extract and output high-frequency components out of the audio band of the audio signal.

In step S32, the detector 62 performs the noise detection process in accordance with powers or the like of high-frequency components out of the audio band of the audio signal supplied from the HPF unit 61 so as to output a control signal c.

In step S33, the LPF unit 71 of the gain controller 52 determines whether noise unique to a PDM signal has been detected through the noise detection process performed in step S32 in accordance with the control signal c supplied from the detector 62. When the control signal c represents detection of noise, it is determined that the noise unique to a PDM signal has been detected in step S33, and the process proceeds to step S34.

In step S34, the LPF unit 71 performs the LPF process on the audio signal so as to attenuate the high-frequency components out of the audio band of the audio signal and supplies the components to the time-frequency transform unit 11 (shown in FIG. 5). Then, the process returns to step S11 shown in FIG. 8 and proceeds to step S12.

On the other hand, when the control signal c represents that the noise has not been detected, it is determined that the noise unique to a PDM signal has not been detected in step S33 and the LPF unit 71 supplies the audio signal to the time-frequency transform unit 11 without change. Then, the process returns to step S11 shown in FIG. 8 and proceeds to step S12.

Detailed Examples of Configurations of Noise Detector and Gain Controller

Figure 10:
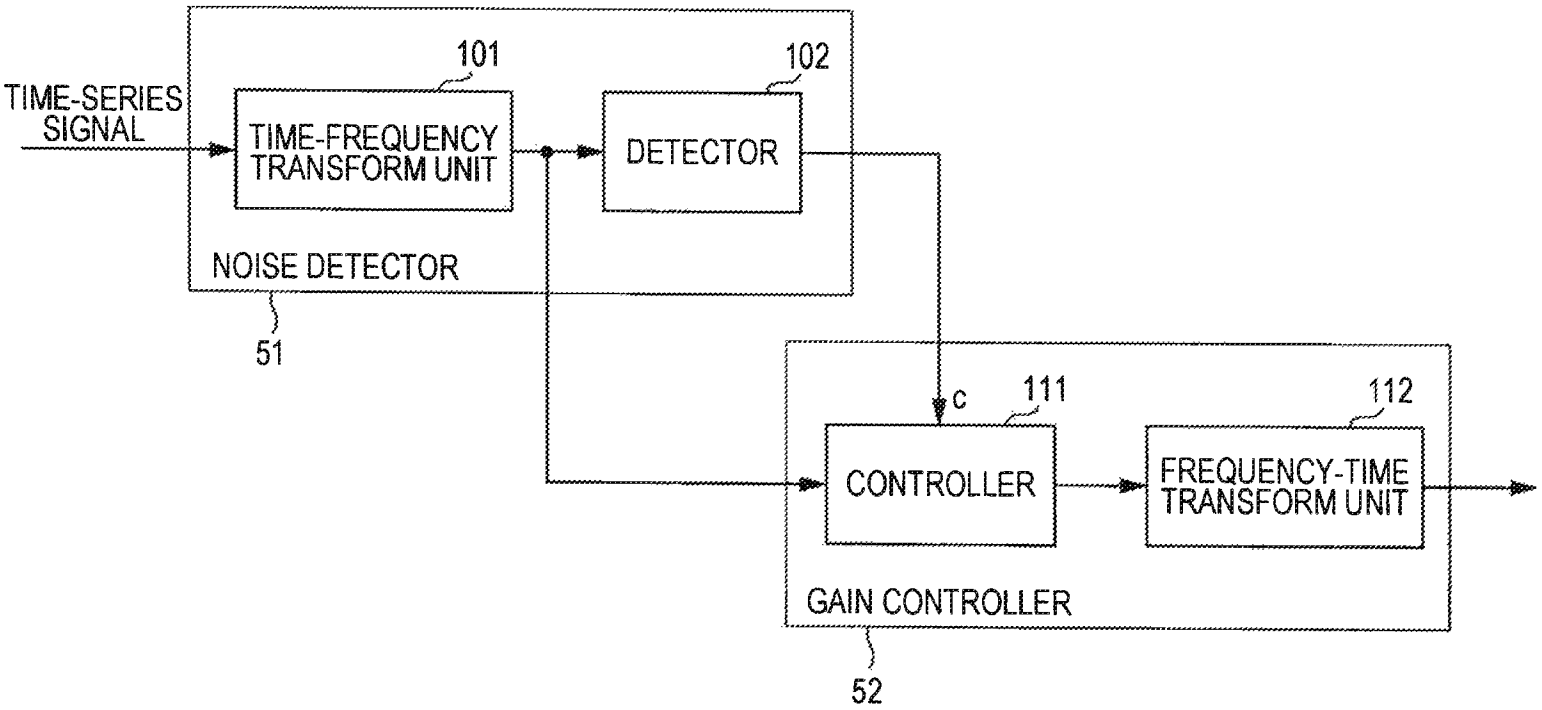
FIG. 10 is a diagram illustrating another configuration of the noise detector and the gain controller shown in FIG. 5 in detail.

FIG. 10 is a block diagram illustrating other configurations of the noise detector 51 and the gain controller 52 in detail.

The noise detector 51 shown in FIG. 51 includes a time-frequency transform unit 101 and a detector 102 and the gain controller 52 includes a controller 111 and a frequency-time transform unit 112. The noise detector 51 and the gain controller 52 shown in FIG. 10 perform a noise detection process and gain control, respectively, on a frequency-region signal of an audio signal.

Specifically, the time-frequency transform unit 101 of the noise detector 51 shown in FIG. 10 performs time-frequency transform such as FFT (Fast Fourier Transform) or MDCT on the audio signal input as a time-series signal and outputs resultant frequency spectra.

The detector 102 performs the noise detection process in accordance with powers or the like of high-frequency components out of the audio band of the frequency spectra supplied from the time-frequency transform unit 101 so as to output a control signal c.

The controller 111 of the gain controller 52 performs gain control on the frequency spectra supplied from the time-frequency transform unit 101 in accordance with the control signal c supplied from the detector 102. Specifically, when the control signal c represents detection of noise, the controller 111 performs the gain control on the frequency spectra such that the powers of the high-frequency components out of the audio band are monotonically reduced with certain inclination. Then, the controller 111 outputs the frequency spectra obtained after the gain control. On the other hand, when the control signal represents that the noise has not been detected, the controller 111 outputs the frequency spectra without change.

The frequency-time transform unit 112 performs frequency-time transform such as IFFT (Inverse Fast Fourier Transform) or IMDCT (Inverse Modified Discrete Cosine Transform) on the frequency spectra supplied from the controller 111. By this, when the noise unique to a PDM signal is detected, an audio signal in which high-frequency components out of the audio band are attenuated is obtained whereas when the noise unique to a PDM signal is not detected, an original audio signal input to the audio encoding apparatus 50 is obtained. The frequency-time transform unit 112 supplies the audio signal obtained as a result of the frequency-time transform to the time-frequency transform unit 11 shown in FIG. 5.

Noise Detection Process

FIGS. 11 to 14 are diagrams illustrating first to third examples of the noise detection process performed by the detector 102 shown in FIG. 10. Note that, in FIGS. 11 to 14, an axis of abscissa denotes an index of a frequency spectrum and an axis of ordinate denotes a power of a frequency spectrum. The same is true to FIGS. 15 to 17 which will be described hereinafter.

Figure 11:
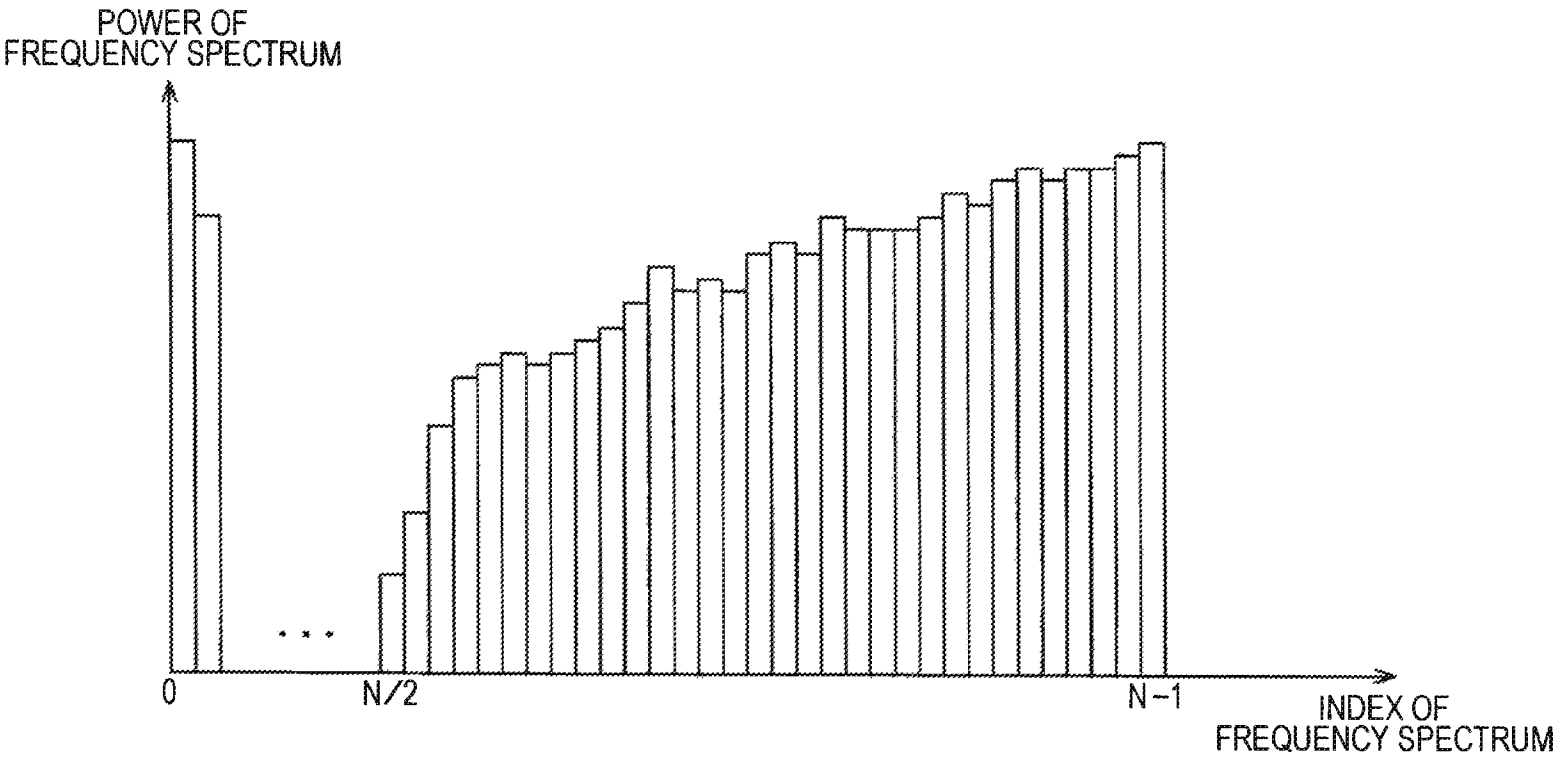
FIG. 11 is a diagram illustrating frequency spectra.

FIG. 11 is a diagram illustrating frequency spectra output from the time-frequency transform unit 101.

In the example shown in FIG. 11, a sampling frequency of an audio signal input as a time-series signal is 96 kHz, and among N frequency spectra having indices of 0 to N−1, N/2 frequency spectra having indices of N/2 to N−1 correspond to frequency spectra having high frequency components out of the audio band.

Figure 12:
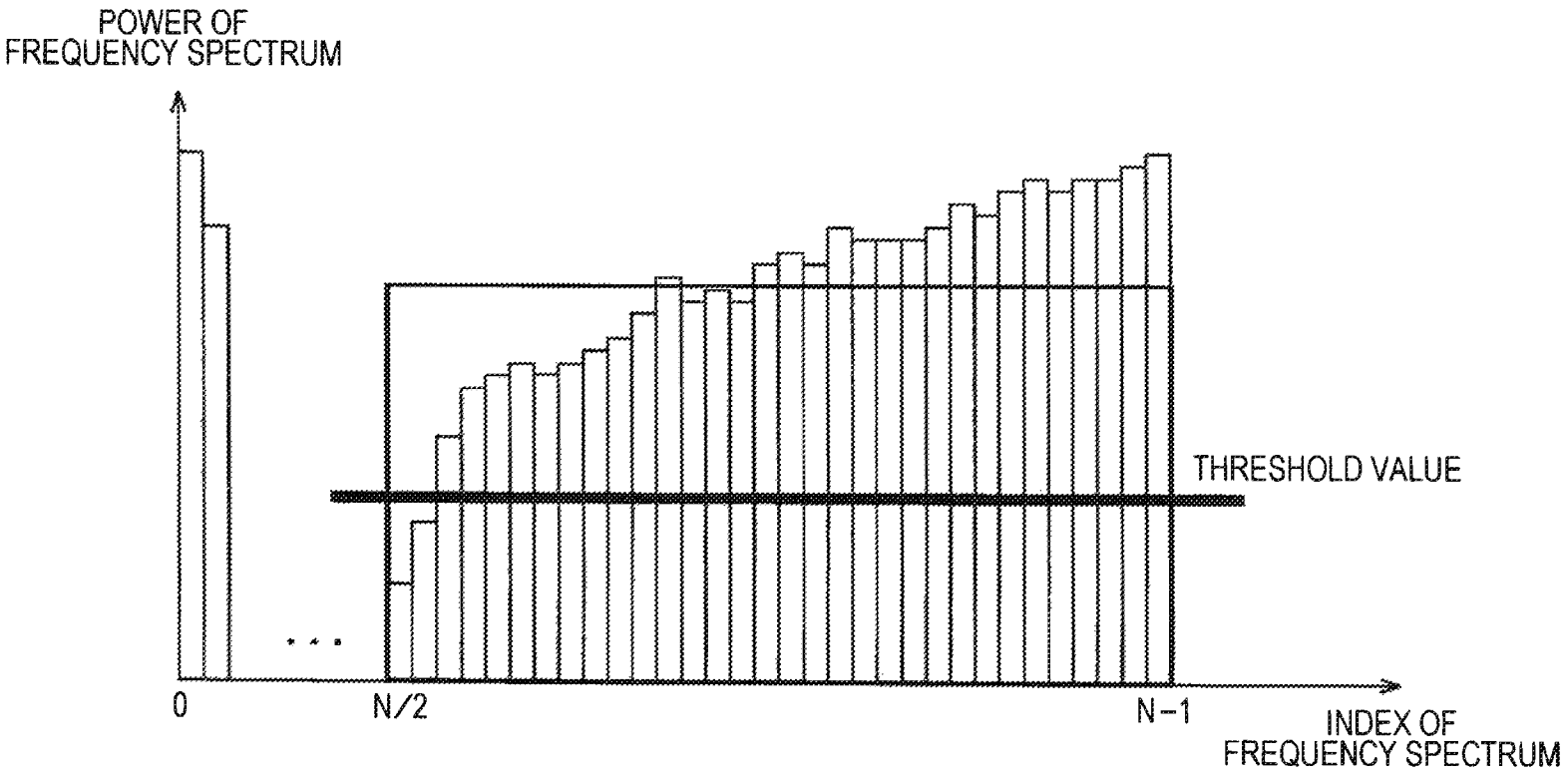
FIG. 12 is a diagram illustrating a first noise detection process performed on the frequency spectra.

FIG. 12 is a diagram illustrating the first noise detection process performed on the frequency spectra shown in FIG. 11. Note that, in FIG. 12, solid lines represent powers of the frequency spectra shown in FIG. 11, a middle-thick line represents a total power of the frequency spectra out of the audio band, and a bold line represents a predetermined threshold value.

As shown in FIG. 12, in the first example of the noise detection process, when the total power of the frequency spectra out of the audio band is equal to or larger than the predetermined threshold value, noise unique to a PDM signal is detected.

Figure 13:
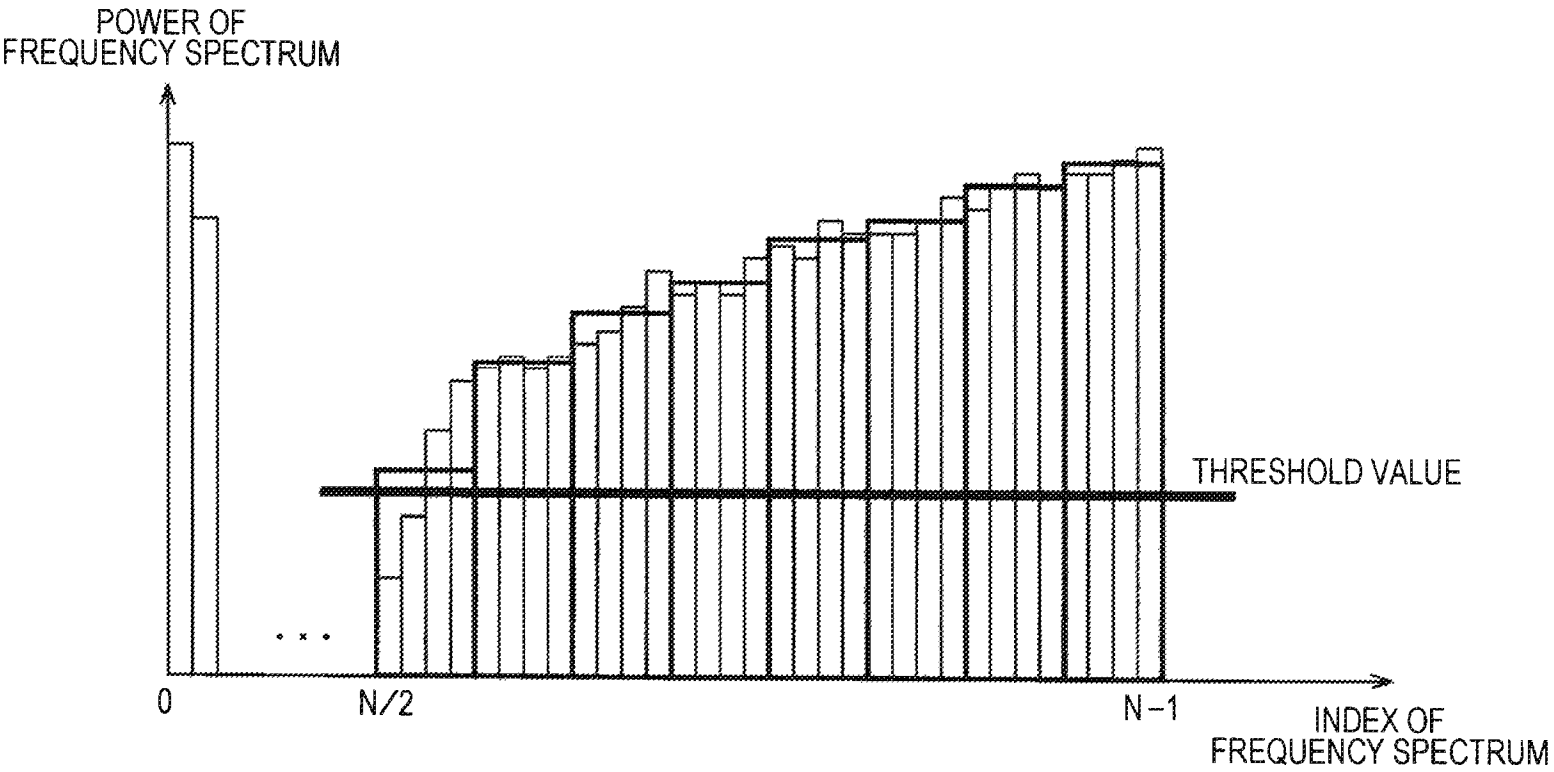
FIG. 13 is a diagram illustrating a second noise detection process performed on the frequency spectra.

FIG. 13 is a diagram illustrating the second noise detection process performed on the frequency spectra shown in FIG. 11. Note that, in FIG. 13, solid lines represent the powers of the frequency spectra shown in FIG. 11, middle-thick lines represent total powers of groups of the frequency spectra, and a bold line represents the predetermined threshold value.

As shown in FIG. 13, in the second example of the noise detection process, when all the total powers of the groups of the frequency spectra out of the audio band are equal to or larger than the predetermined threshold value, noise unique to a PDM signal is detected.

Figure 14:
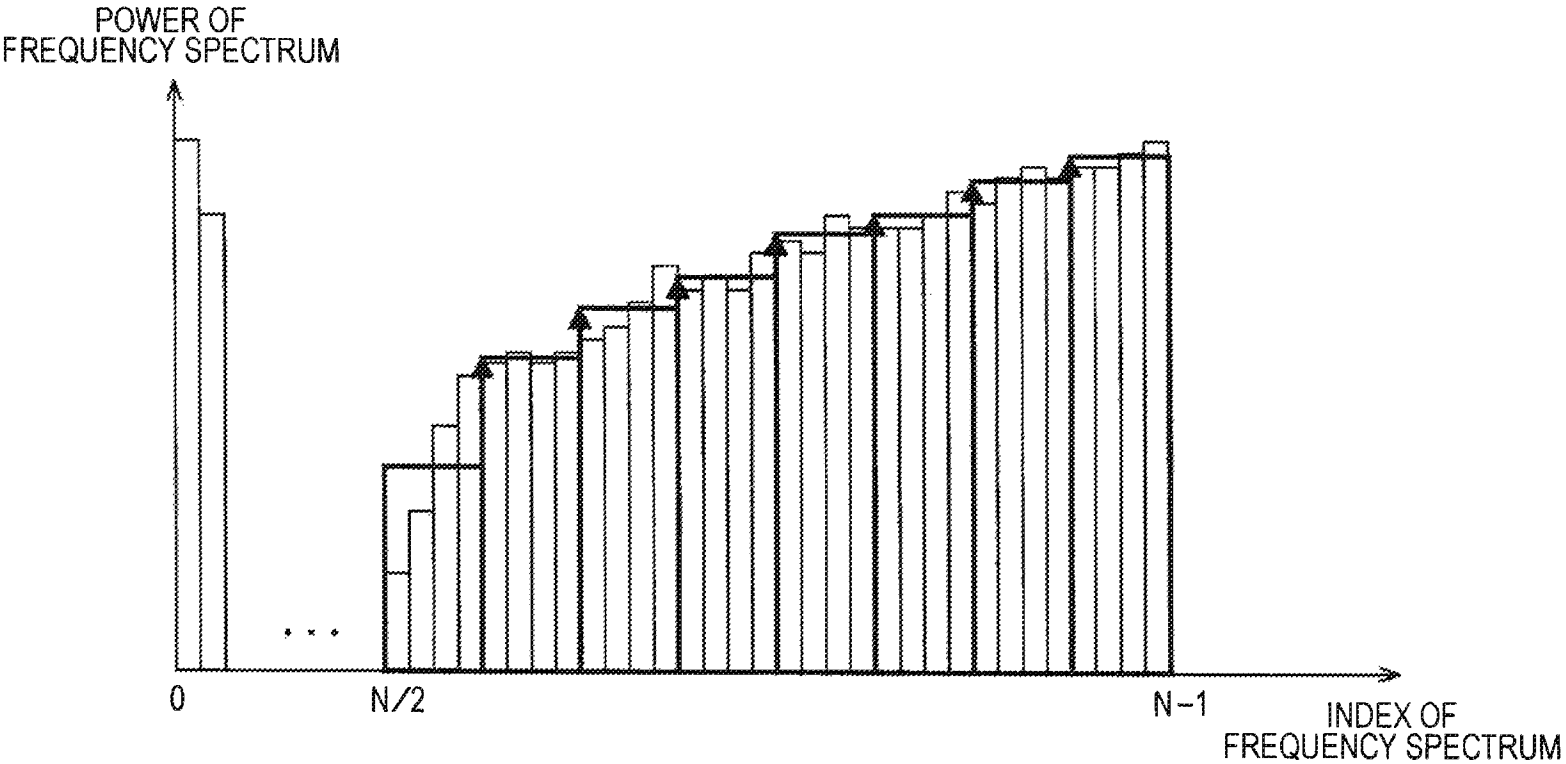
FIG. 14 is a diagram illustrating a third noise detection process performed on the frequency spectra.

FIG. 14 is a diagram illustrating the third noise detection process performed on the frequency spectra shown in FIG. 11. Note that, in FIG. 14, solid lines represent the powers of the frequency spectra shown in FIG. 11, and middle-thick lines represent the total powers of groups of the frequency spectra.

As shown in FIG. 14, in the third example of the noise detection process, when the total powers of the groups of the frequency spectra out of the audio band are monotonically increased, noise unique to a PDM signal is detected.

Note that, in the second and third examples of the noise detection process, the determinations are made on the basis of the total powers of the groups. However, a determination may be made in accordance with the powers of the individual frequency spectra.

Furthermore, the noise detection process performed by the detector 102 may be one of the first to third examples or may be a combination of the first to third examples. Furthermore, the noise detection process performed by the detector 102 is not limited to the first to third examples described above.

Gain Control

Figure 15:
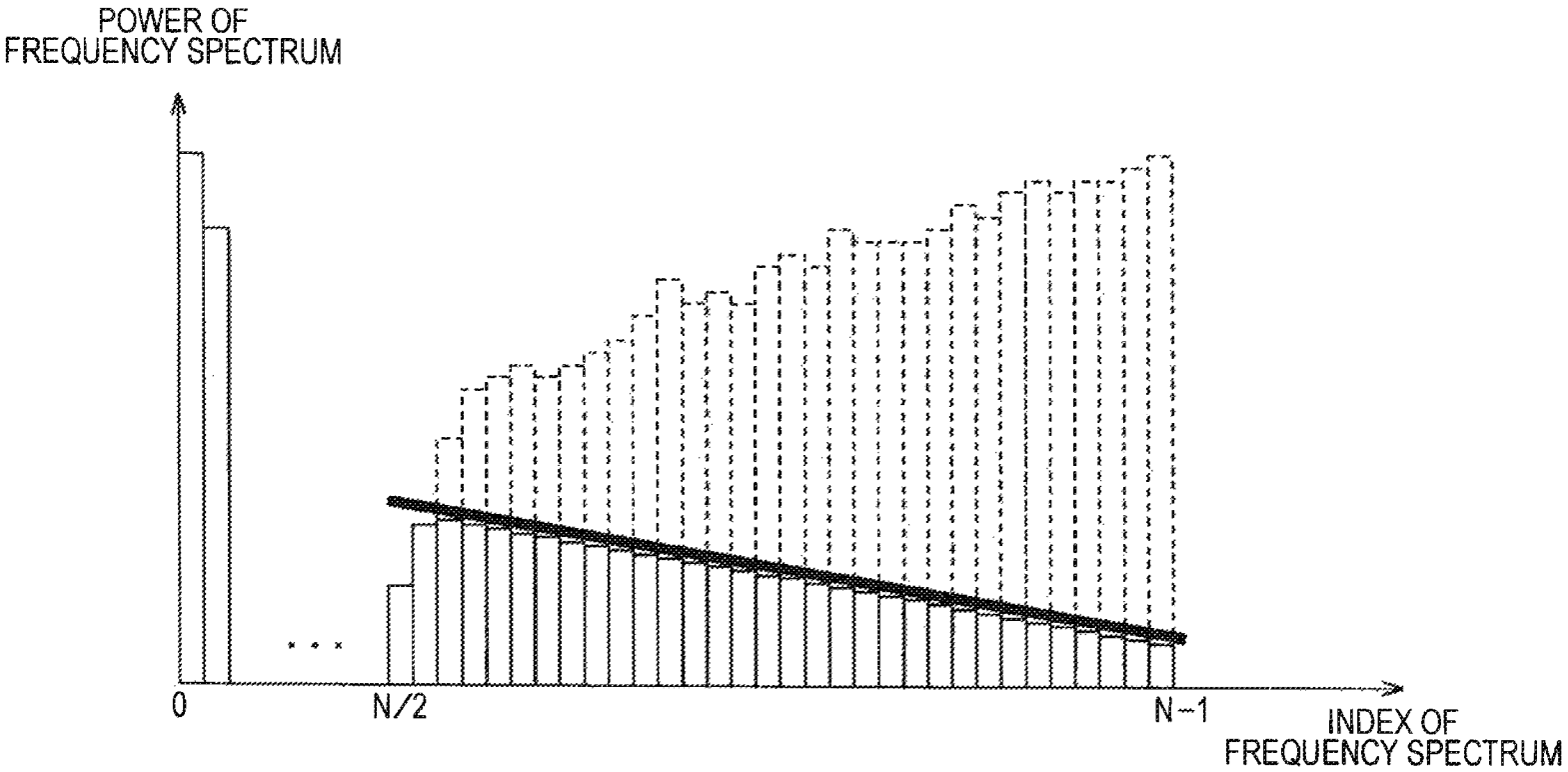
FIG. 15 is a diagram illustrating first gain control performed on the frequency spectra.
Figure 16:
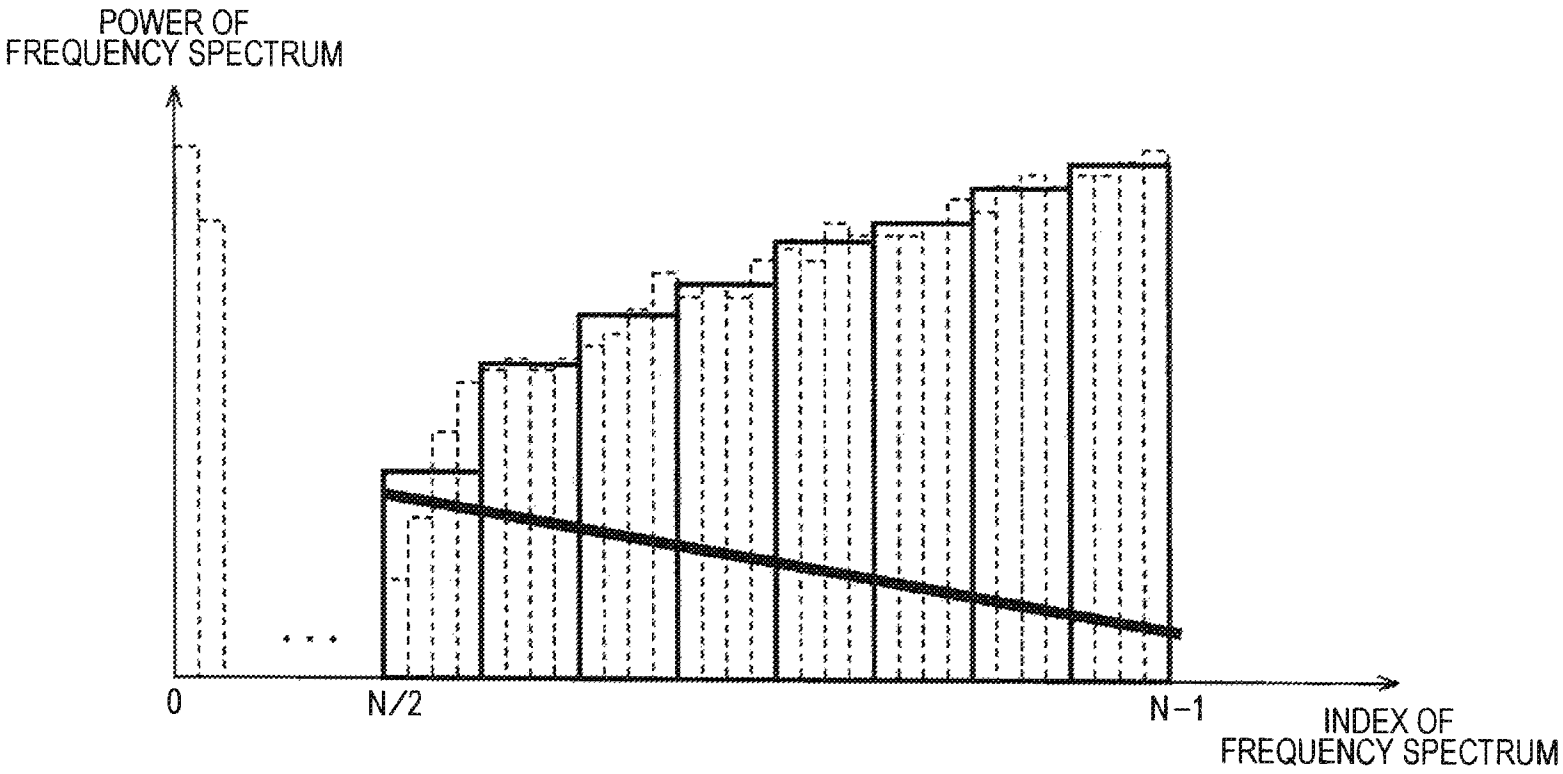
FIG. 16 is a diagram illustrating second gain control performed on the frequency spectra.
Figure 17:
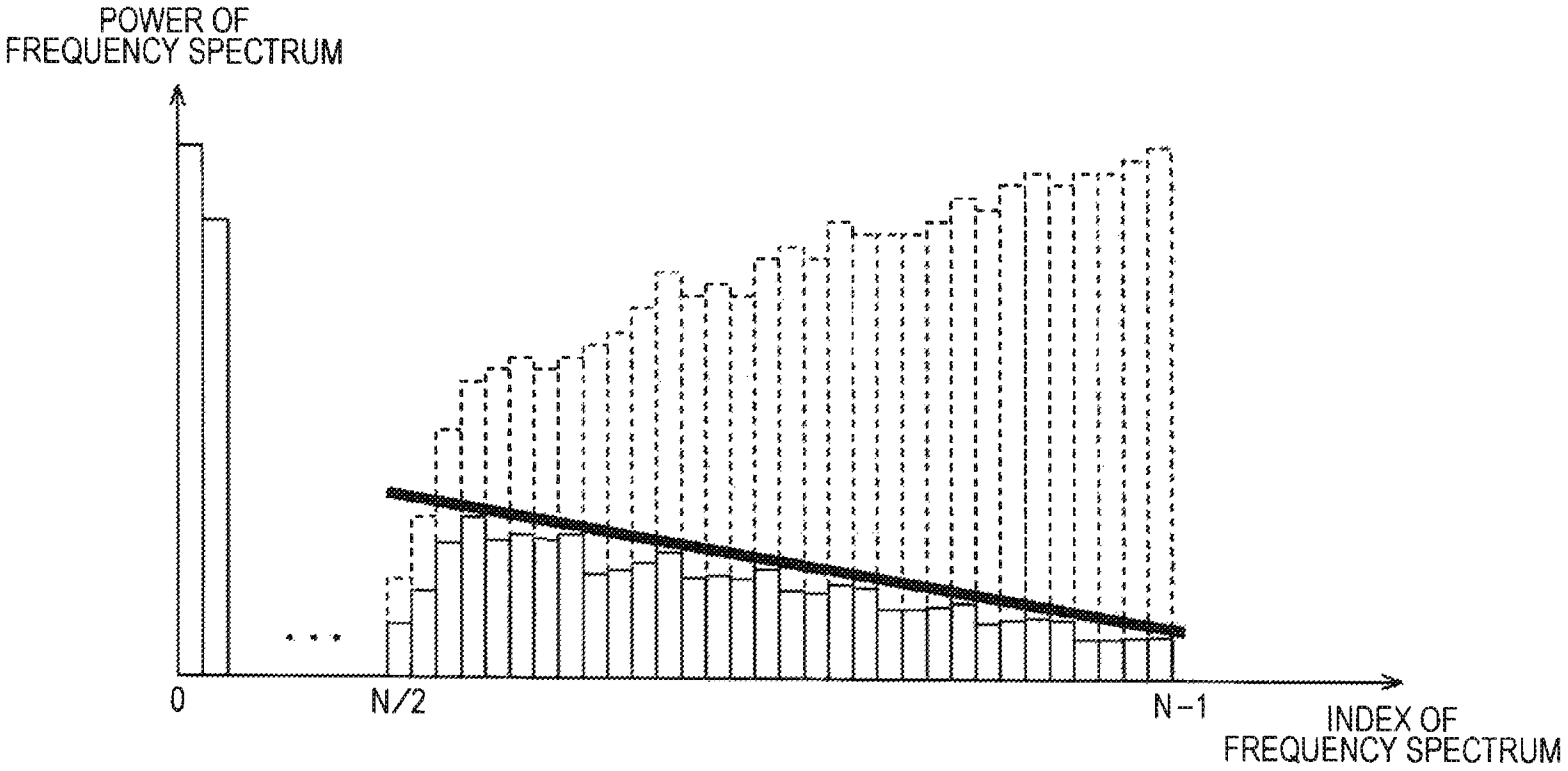
FIG. 17 is a diagram illustrating third gain control performed on the frequency spectra.

FIGS. 15 to 17 are diagrams illustrating first and second examples of the gain control performed by the controller 111 on the frequency spectra shown in FIG. 11.

FIG. 15 is a diagram illustrating the first example of the gain control. Note that, in FIG. 15, dotted lines denote the frequency spectra shown in FIG. 11 which have not been subjected to the gain control, solid lines denote frequency spectra which have been subjected to the gain control, and a bold line denotes inclination of the gain control.

As shown in FIG. 15, in the first example of the gain control, gains of the frequency spectra are controlled so that powers of the frequency spectra out of the audio band are monotonically reduced in a predetermined inclination.

FIGS. 16 and 17 are diagrams illustrating the second example of the gain control. Note that, in FIGS. 16 and 17, dotted lines denote the frequency spectra shown in FIG. 11 which have not been subjected to the gain control and a bold line denotes inclination of the gain control. Furthermore, middle-thick lines shown in FIG. 16 denote total powers of groups including a plurality of frequency spectra, and solid lines shown in FIG. 17 denote frequency spectra which have been subjected to the gain control.

As shown in FIG. 16, in the second example of the gain control, the frequency spectra out of the audio band are divided into groups each of which includes some of the frequency spectra. Then, as shown in FIG. 17, gains of the frequency spectra are controlled so that total powers of the groups are monotonically reduced in a predetermined inclination.

Note that the gain control performed by the controller 111 is not limited to the first and second examples described above.

Another Noise Reduction Process

Figure 18:
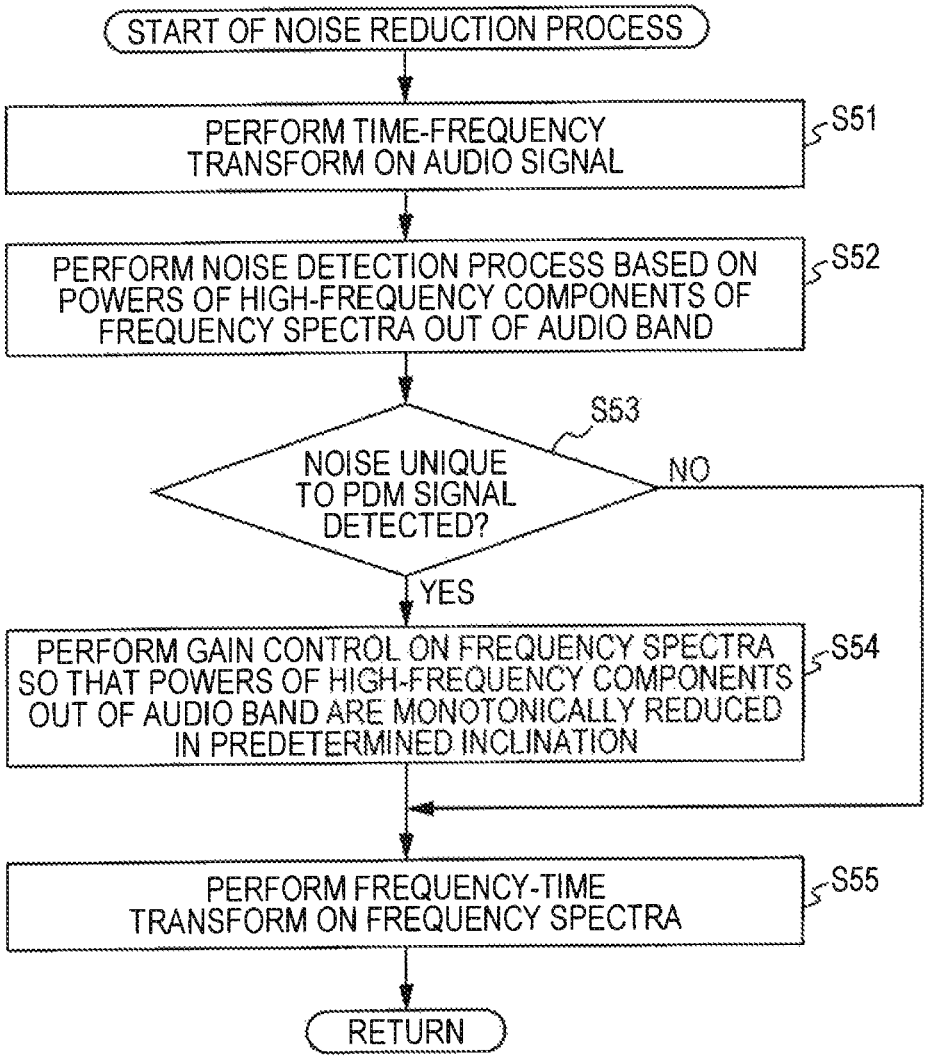
FIG. 18 is a flowchart illustrating another noise reduction process shown in FIG. 8.

FIG. 18 is a flowchart illustrating a noise reduction process performed in step S11 of FIG. 8 by the noise detector 51 and the gain controller 52 shown in FIG. 10.

In step S51 shown in FIG. 18, the time-frequency transform unit 101 of the noise detector 51 shown in FIG. 10 performs time-frequency transform on an audio signal input as a time-series signal and outputs resultant frequency spectra.

In step S52, the detector 102 performs the noise detection process described with reference to FIGS. 11 to 14 in accordance with the powers or the like of the high-frequency components out of the audio band of the frequency spectra supplied from the time-frequency transform unit 101 so as to output a control signal c.

In step S53, the controller 111 of the gain controller 52 determines whether noise unique to a PDM signal has been detected through the noise detection process performed in step S52 in accordance with the control signal c supplied from the detector 102. When the control signal c represents detection of noise, it is determined that the noise unique to a PDM signal has been detected in step S53, and the process proceeds to step S54.

In step S54, the controller 111 performs the gain control on the frequency spectra output from the time-frequency transform unit 101 so that the powers of the high-frequency components out of the audio band are monotonically reduced in the predetermined inclination as shown in FIGS. 15 to 17. Then, the controller 111 outputs the frequency spectra obtained after the gain control, and the process proceeds to step S55.

On the other hand, when the control signal c represents that the noise has not been detected, it is determined that the noise unique to a PDM signal has not been detected in step S53 and the LPF unit 111 supplies the frequency spectra supplied from the time-frequency transform unit 101 without change. Then, the process proceeds to step S55.

In step S55, the frequency-time transform unit 112 performs frequency-time transform on the frequency spectra supplied from the controller 111. The frequency-time transform unit 112 supplies a resultant audio signal to the time-frequency transform unit 11 shown in FIG. 5. Then, the process returns to step S11 shown in FIG. 8 and proceeds to step S12.

As described above, the audio encoding apparatus 50 performs the noise detection process in accordance with an audio signal before performing the bit allocation calculation. Furthermore, when the noise unique to a PDM signal is detected through the noise detection process, the audio signal is subjected to the gain control so that the high frequency components out of the audio band of the audio signal attenuate. By this, the number of bits allocated to the noise unique to a PDM signal may be reduced and the number of bits allocated to the audio band which is important in terms of acoustic sense may be increased. As a result, high-accuracy encoding may be performed on a multi-bit PCM signal generated from a PDM signal including noise unique to a PDM signal. Accordingly, a high-quality multi-bit PCM signal may be recorded and transmitted with high quality.

Second Embodiment

Example of Configuration of Audio Encoding Apparatus of Second Embodiment

Figure 19:
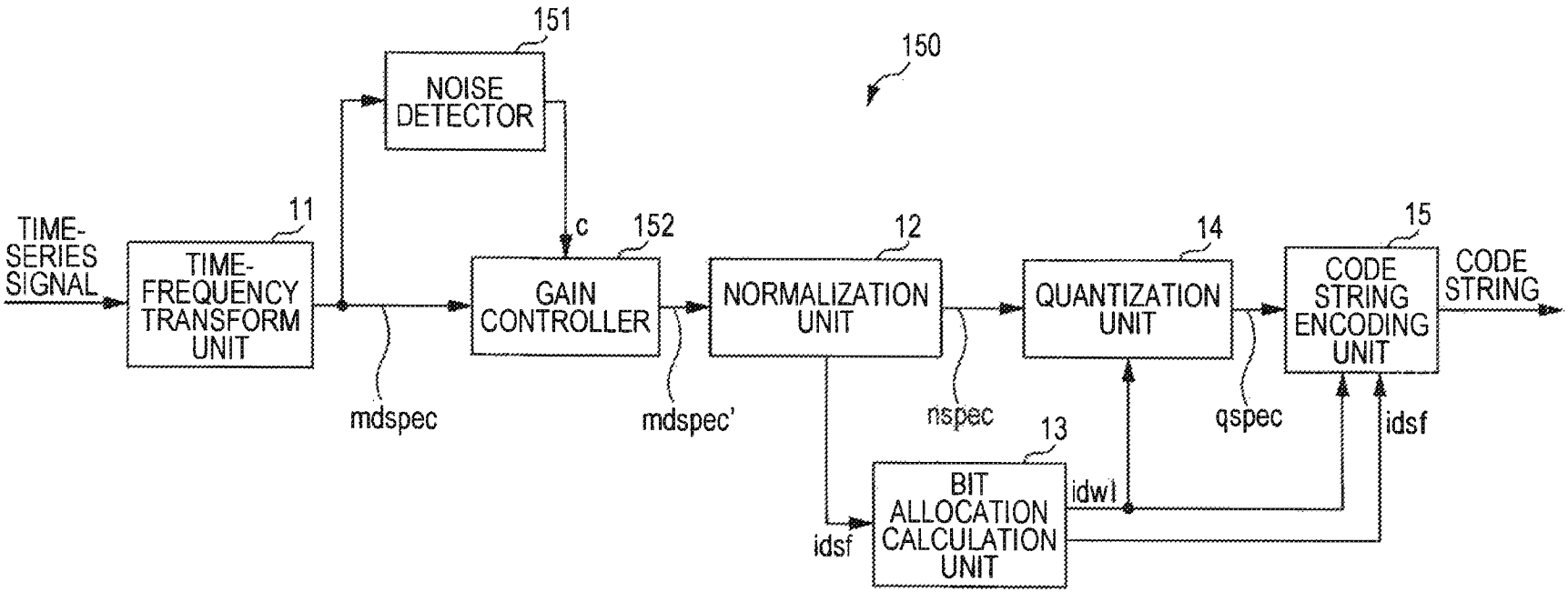
FIG. 19 is a block diagram illustrating a configuration of an audio encoding apparatus according to a second embodiment of the present disclosure.

FIG. 19 is a block diagram illustrating a configuration of an audio encoding apparatus according to a second embodiment of the present disclosure.

In FIG. 19, components the same as those shown in FIG. 1 are denoted by reference numerals the same as those shown in FIG. 1. Redundant descriptions are appropriately omitted.

A configuration of an audio encoding apparatus 150 shown in FIG. 19 is different from the configuration shown in FIG. 1 in that a noise detector 151 and a gain controller 152 are disposed between a time-frequency transform unit 11 and a normalization unit 12. The audio encoding apparatus 150 performs a noise detection process and gain control on frequency spectra mdspec obtained by the time-frequency transform unit 11.

Specifically, the noise detector 151 of the audio encoding apparatus 150 is configured similarly to the detector 102 shown in FIG. 10. The detector 151 performs a noise detection process as shown in FIGS. 11 to 14 in accordance with powers or the like of high-frequency components out of an audio band of frequency spectra supplied from the time-frequency transform unit 11 so as to output a control signal c.

The gain controller 152 is configured similarly to the controller 111 shown in FIG. 10. The gain controller 152 performs gain control on the frequency spectra supplied from the time-frequency transform unit 11 in accordance with the control signal c supplied from the noise detector 151. Specifically, when the control signal c represents detection of noise, the gain controller 152 performs the gain control described with reference to FIGS. 15 to 17 on the frequency spectra such that the powers of the high-frequency components out of the audio band are monotonically reduced with certain inclination. Then, the gain controller 152 outputs frequency spectra mdspec' obtained after the gain control. On the other hand, when the control signal represents that the noise has not been detected, the gain controller 152 outputs the frequency spectra mdspec without change as the frequency spectra mdspec'. The frequency spectra mdspec' output from the gain controller 152 are supplied to the normalization unit 12.

Processing of Audio Encoding Apparatus

Figure 20:
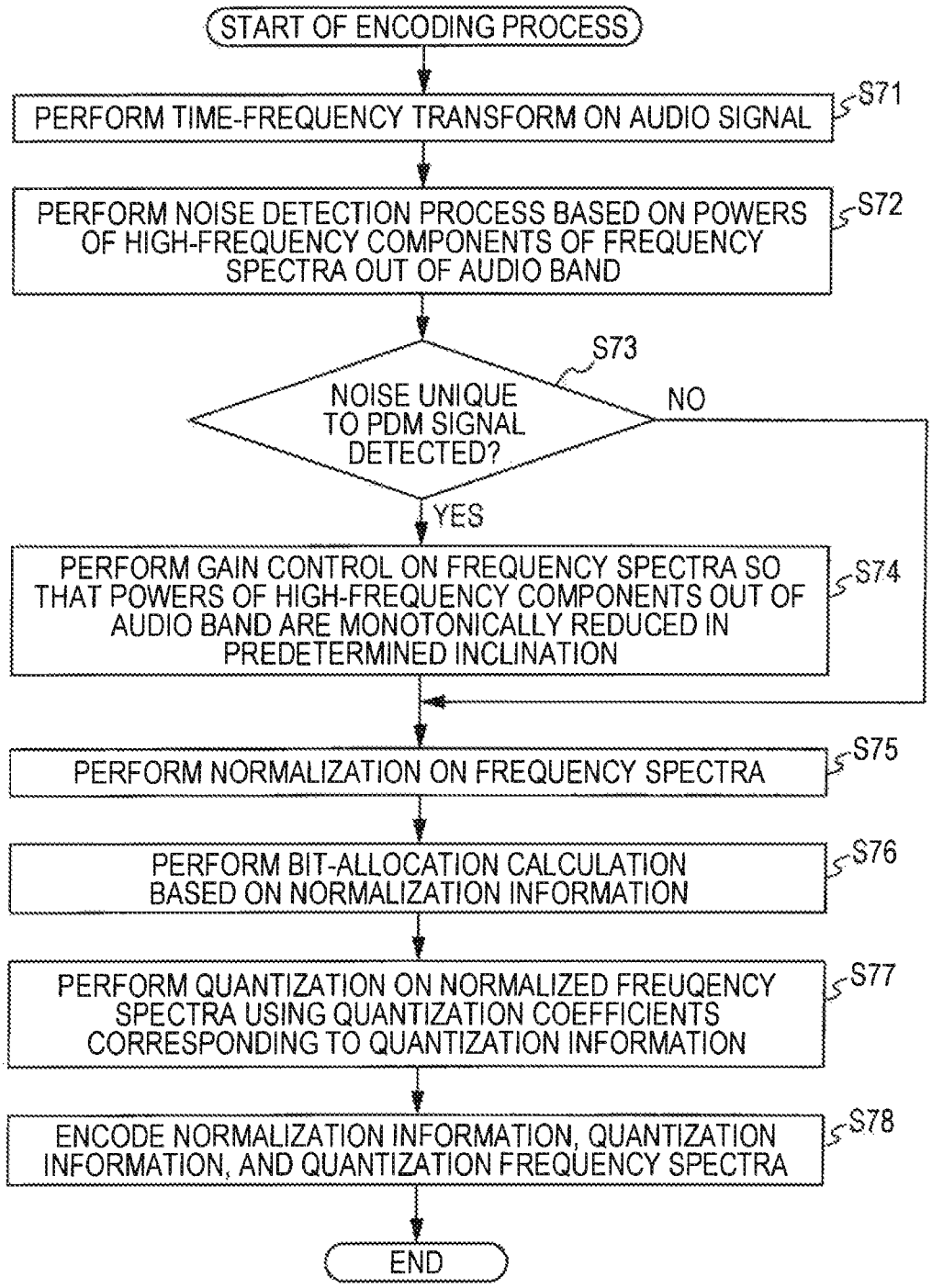
FIG. 20 is a flowchart illustrating an encoding process performed by the audio encoding apparatus shown in FIG. 19.

FIG. 20 is a flowchart illustrating an encoding process performed by the audio encoding apparatus 150 shown in FIG. 19. The encoding process is started when an audio signal which is a time-series signal is supplied to the audio encoding apparatus 150.

In step S71 of FIG. 20, the time-frequency transform unit 11 performs time-frequency transform on the audio signal input as the time-series signal and outputs resultant frequency spectra mdspec.

In step S72, the detector 151 performs the noise detection process as described in FIGS. 11 to 14 on the basis of powers or the like of high-frequency components out of the audio band of the frequency spectra mdspec supplied from the time-frequency transform unit 11 so as to output a control signal c.

In step S73, the gain controller 152 determines whether noise unique to a PDM signal has been detected through the noise detection process performed in step S72 in accordance with the control signal c supplied from the noise detector 151. When the control signal c represents detection of noise, it is determined that the noise unique to a PDM signal has been detected in step S73, and the process proceeds to step S74.

In step S74, the controller 152 performs gain control on the frequency spectra mdspec output from the time-frequency transform unit 11 so that the powers of the high-frequency components out of the audio band are monotonically reduced in predetermined inclination as shown in FIGS. 15 to 17. Then, the gain controller 152 outputs frequency spectra mdspec' obtained after the gain control, and the process proceeds to step S75.

On the other hand, when the control signal c represents that the noise has not been detected, it is determined that the noise unique to a PDM signal has not been detected in step S73 and the gain controller 152 outputs the frequency spectra mdspec as frequency spectra mdspec' without change. Then, the process proceeds to step S75.

In step S75, the normalization unit 12 performs normalization on the frequency spectra mdspec' supplied from the gain controller 152 for each predetermined processing unit using normalization coefficients sf(idsf) corresponding to amplitudes of the frequency spectra mdspec'. The normalization unit 12 outputs normalization information idsf corresponding to the normalization coefficients sf(idsf) and normalization frequency spectra nspec obtained as a result of the normalization.

The process from step S76 to step S78 is the same as the process from step S14 to step S16 shown in FIG. 8, and therefore, a description thereof is omitted.

As described above, the audio encoding apparatus 150 performs the noise detection process in accordance with the frequency spectra of the audio signal before performing the bit allocation calculation. Furthermore, when the noise unique to a PDM signal is detected through the noise detection process, the frequency spectra are subjected to the gain control so that the high frequency components out of the audio band of the audio signal attenuate. By this, the number of bits allocated to the noise unique to a PDM signal may be reduced and the number of bits allocated to the audio band which is important in terms of acoustic sense may be increased. As a result, high-accuracy encoding may be performed on a multi-bit PCM signal generated from a PDM signal including the noise unique to a PDM signal. Accordingly, a high-quality multi-bit PCM signal may be recorded and transmitted with high quality.

Furthermore, since the audio encoding apparatus 150 performs the noise detection process and the gain control using the frequency spectra mdspec obtained by the time-frequency transform unit 11, the number of modules to be added to the general audio encoding apparatus 10 may be reduced when compared with the audio encoding apparatus 50. Specifically, for example, unlike the audio encoding apparatus 50, the time-frequency transform unit 101 and the frequency-time transform unit 112 may not be additionally used. Accordingly, the audio encoding apparatus 150 may be easily obtained by converting the general audio encoding apparatus 10.

Furthermore, since the audio encoding apparatus 150 performs the noise detection process and the gain control in the course of the encoding process, processing delay may be reduced when compared with the audio encoding apparatus 50.

Third Embodiment

Example of Configuration of Audio Encoding Apparatus of Third Embodiment

Figure 21:
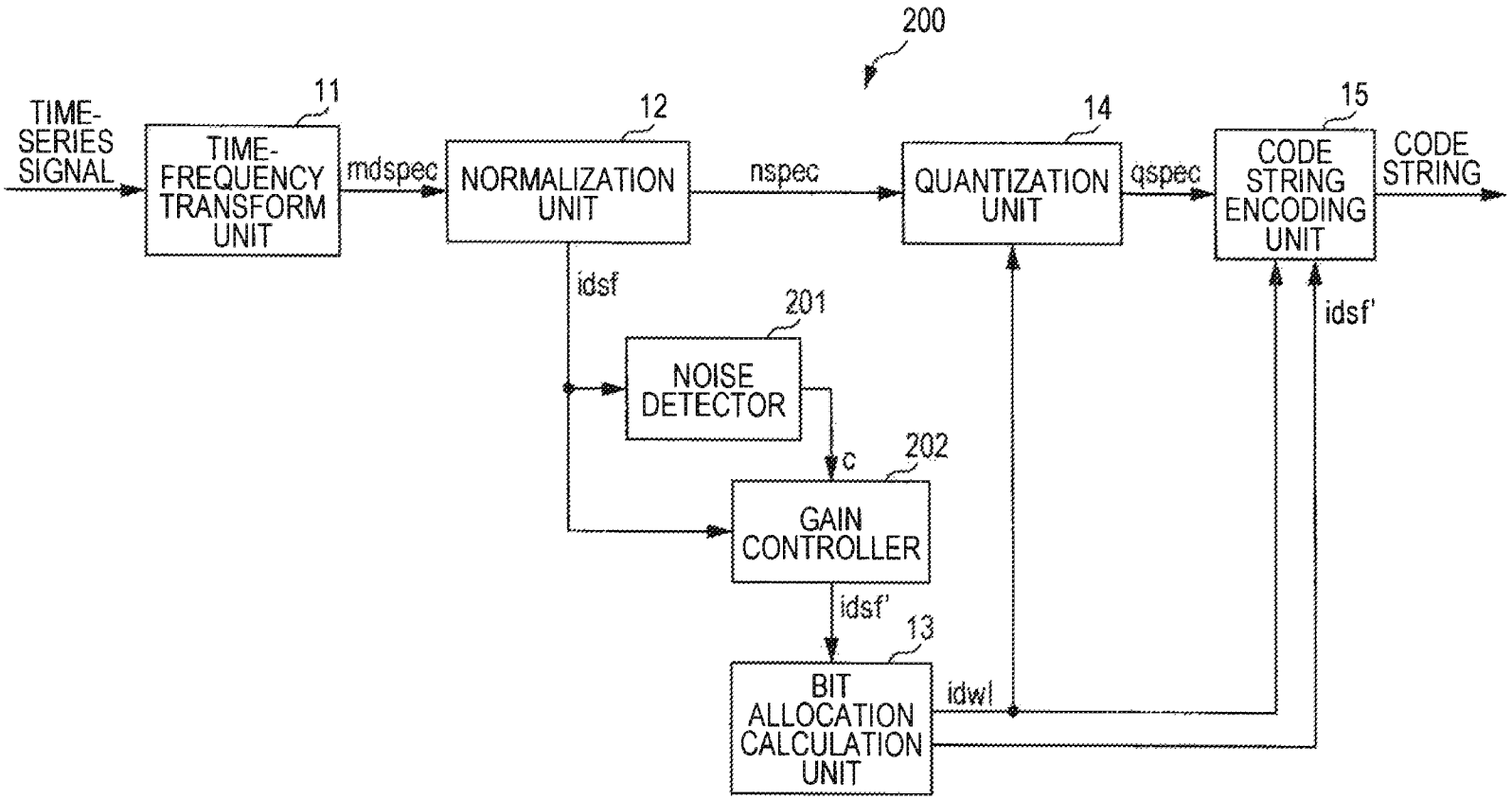
FIG. 21 is a block diagram illustrating a configuration of an audio encoding apparatus according to a third embodiment of the present disclosure.

FIG. 21 is a block diagram illustrating a configuration of an audio encoding apparatus according to a third embodiment of the present disclosure.

In FIG. 21, components the same as those shown in FIG. 1 are denoted by reference numerals the same as those shown in FIG. 1. Redundant descriptions are appropriately omitted.

The configuration of an audio encoding apparatus 200 shown in FIG. 21 is different from the configuration shown in FIG. 1 in that a noise detector 201 and a gain controller 202 are disposed between a normalization unit 12 and a normalization unit 13. The audio encoding apparatus 200 performs a noise detection process and gain control on normalization information idsf of an input audio signal.

Specifically, the noise detector 201 of the audio encoding apparatus 200 performs a noise detection process in accordance with normalization information idsf supplied from the normalization unit 12 and outputs a control signal c.

The gain controller 202 performs gain control on the normalization information idsf supplied from the normalization unit 12 in accordance with the control signal c supplied from the noise detector 201. Specifically, when the control signal c represents detection of noise, the gain controller 202 performs the gain control on the normalization information idsf such that powers of high-frequency components out of an audio band are monotonically reduced with certain inclination. Then, the gain controller 202 outputs normalization information idsf' obtained after the gain control. On the other hand, when the control signal c represents that the noise has not been detected, the gain controller 202 outputs the normalization information idsf without change as normalization information idsf'. The normalization information idsf' output from the gain controller 202 is supplied to the bit allocation calculation unit 13.

Noise Detection Process

FIGS. 22 to 25 are diagrams illustrating first to third noise detection processes performed by the noise detector 201 shown in FIG. 21. Note that, in FIG. 22, an axis of abscissa denotes an index of a frequency spectrum and an axis of ordinate denotes a power of a frequency spectrum. Note that, in FIGS. 23 to 25, an axis of abscissa denotes an index of normalization information and an axis of ordinate denotes normalization information.

Figure 22:
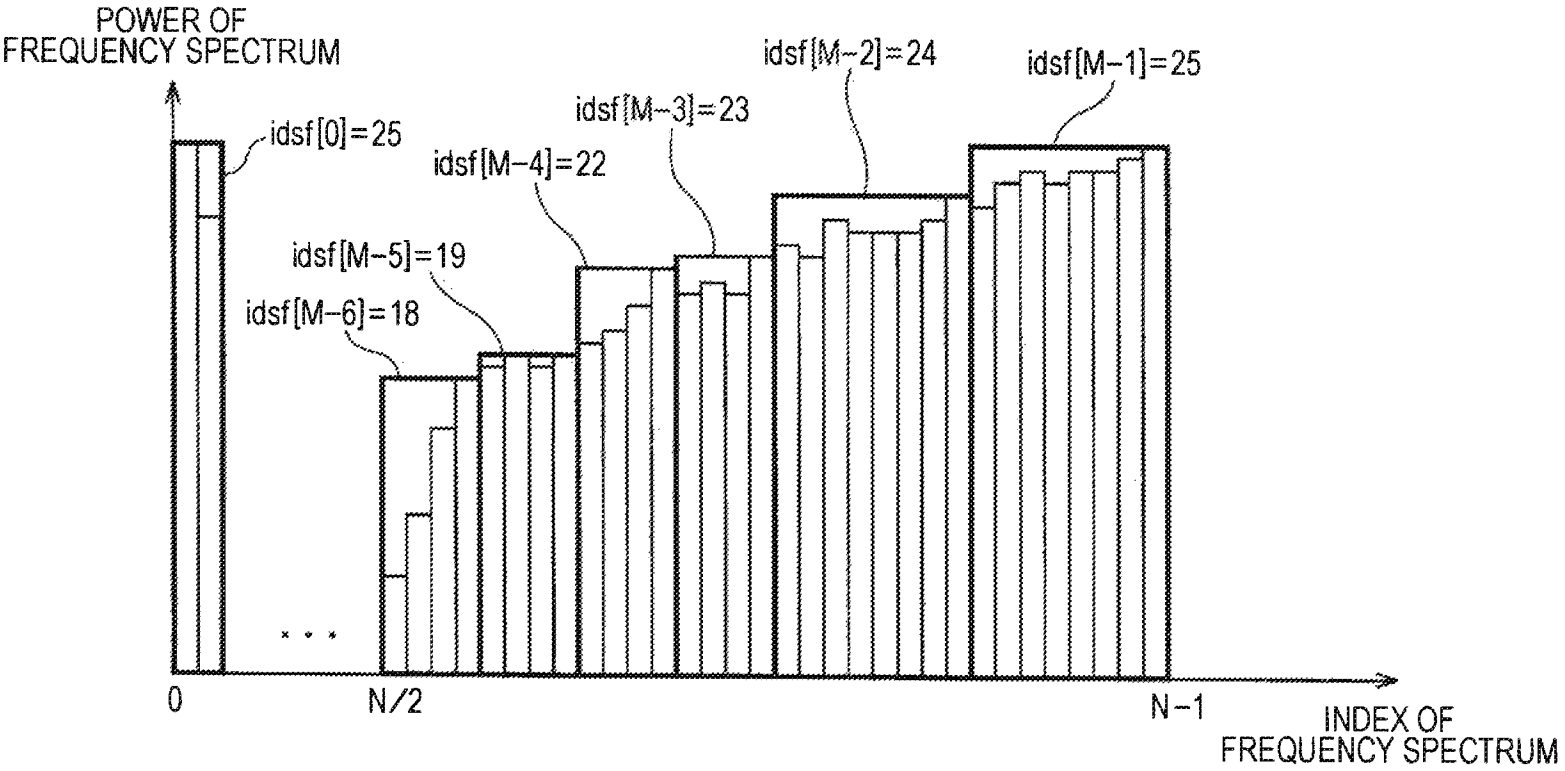
FIG. 22 is a diagram illustrating frequency spectra output from a time-frequency transform unit.

FIG. 22 is a diagram illustrating frequency spectra mdspec output from the time-frequency transform unit 11. Note that, in FIG. 22, solid lines denote powers of the frequency spectra mdspec.

In the example shown in FIG. 22, as with the case of FIG. 11, a sampling frequency of an audio signal input as a time-series signal is 96 kHz, and among N frequency spectra having indices of 0 to N−1, N/2 frequency spectra having indices of N/2 to N−1 correspond to frequency spectra having high frequency components out of an audio band.

Furthermore, normalization and quantization are performed on the frequency spectra mdspec for individual so-called critical band widths denoted by bold lines in FIG. 22. Each of the critical band widths is generally narrower in a lower band and wider in a higher band taking an audio-sense characteristic into consideration. For example, in FIG. 22, the lowest critical band width including the index number 0 includes two frequency spectra mdspec and the highest critical band width including the index number N−1 includes eight frequency spectra mdspec.

Note that, here, a critical band width which is a processing unit for normalization and quantization is referred to as a quantization unit, and N frequency spectra mdspec are divided into M quantization units as groups.

Figure 23:
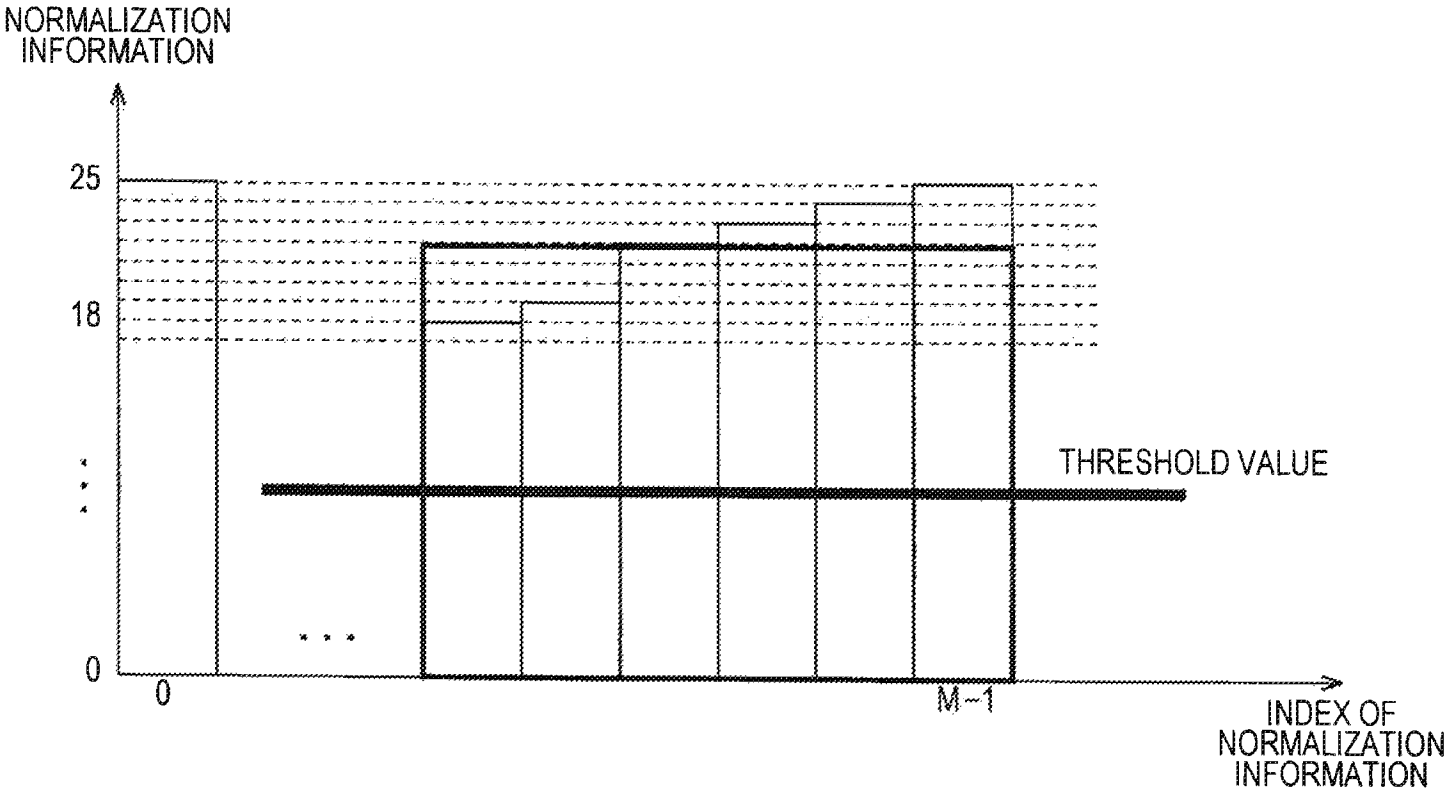
FIG. 23 is a diagram illustrating a first noise detection process performed on normalization information.

FIG. 23 is a diagram illustrating the first noise detection process performed on the normalization information idsf which is a quantization unit of the frequency spectra mdspec shown in FIG. 22. Note that, in FIG. 23, solid lines represent the normalization information idsf, a middle thick line represents a sum of the normalization information idsf out of the audio band, and a bold line represents a threshold value.

As shown in FIG. 23, in the first example of the noise detection process, when the sum of the normalization information idsf of the frequency spectra mdspec out of the audio band is equal to or larger than the predetermined threshold value, noise unique to a PDM signal is detected.

Figure 24:
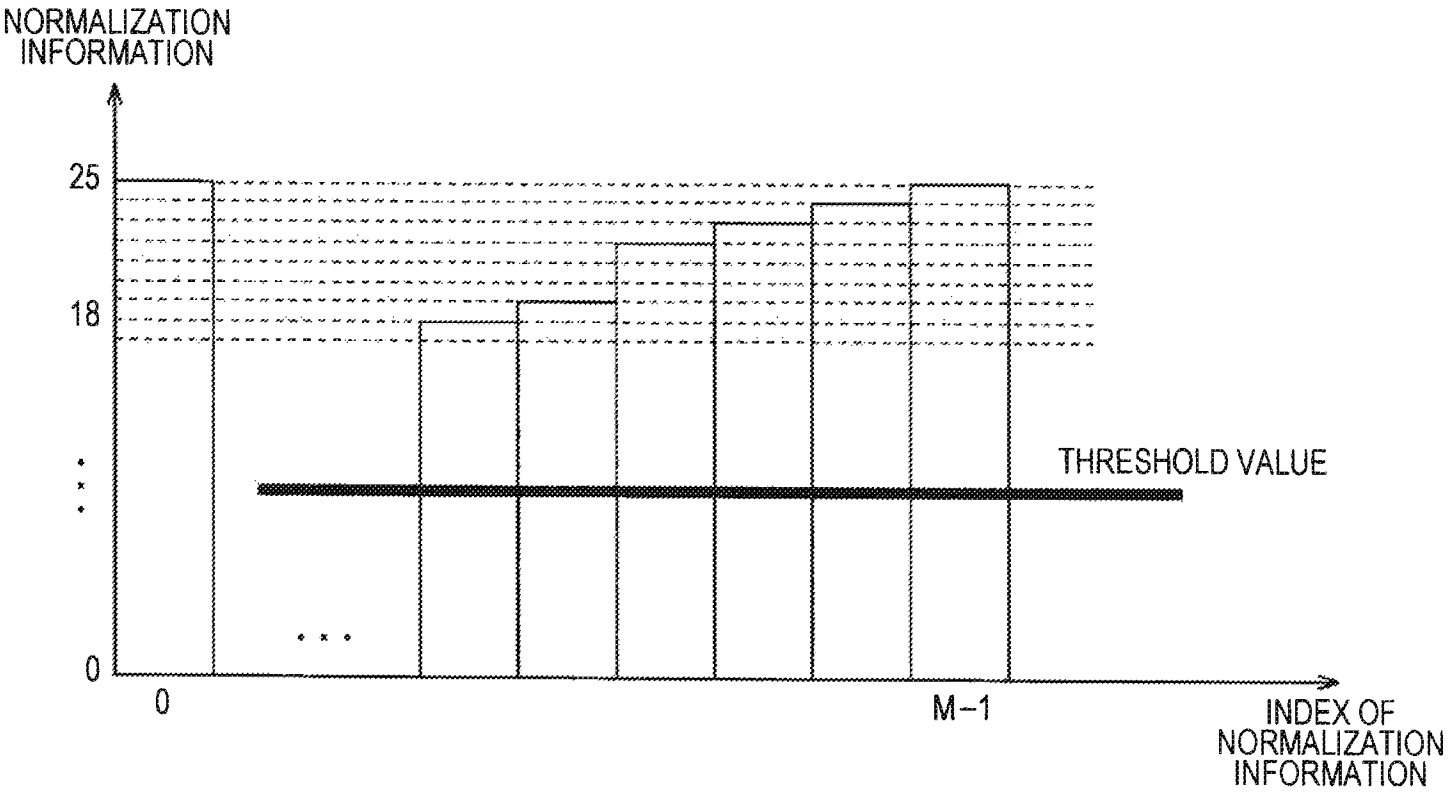
FIG. 24 is a diagram illustrating a second noise detection process performed on normalization information.

FIG. 24 is a diagram illustrating the second noise detection process performed on the normalization information idsf of the frequency spectra mdspec shown in FIG. 22. Note that, in FIG. 24, solid lines represent the normalization information idsf and a bold line represents a threshold value.

As shown in FIG. 24, in the second example of the noise detection process, when all the normalization information idsf of the frequency spectra mdspec out of the audio band is equal to or larger than the predetermined threshold value, the noise unique to a PDM signal is detected.

Figure 25:
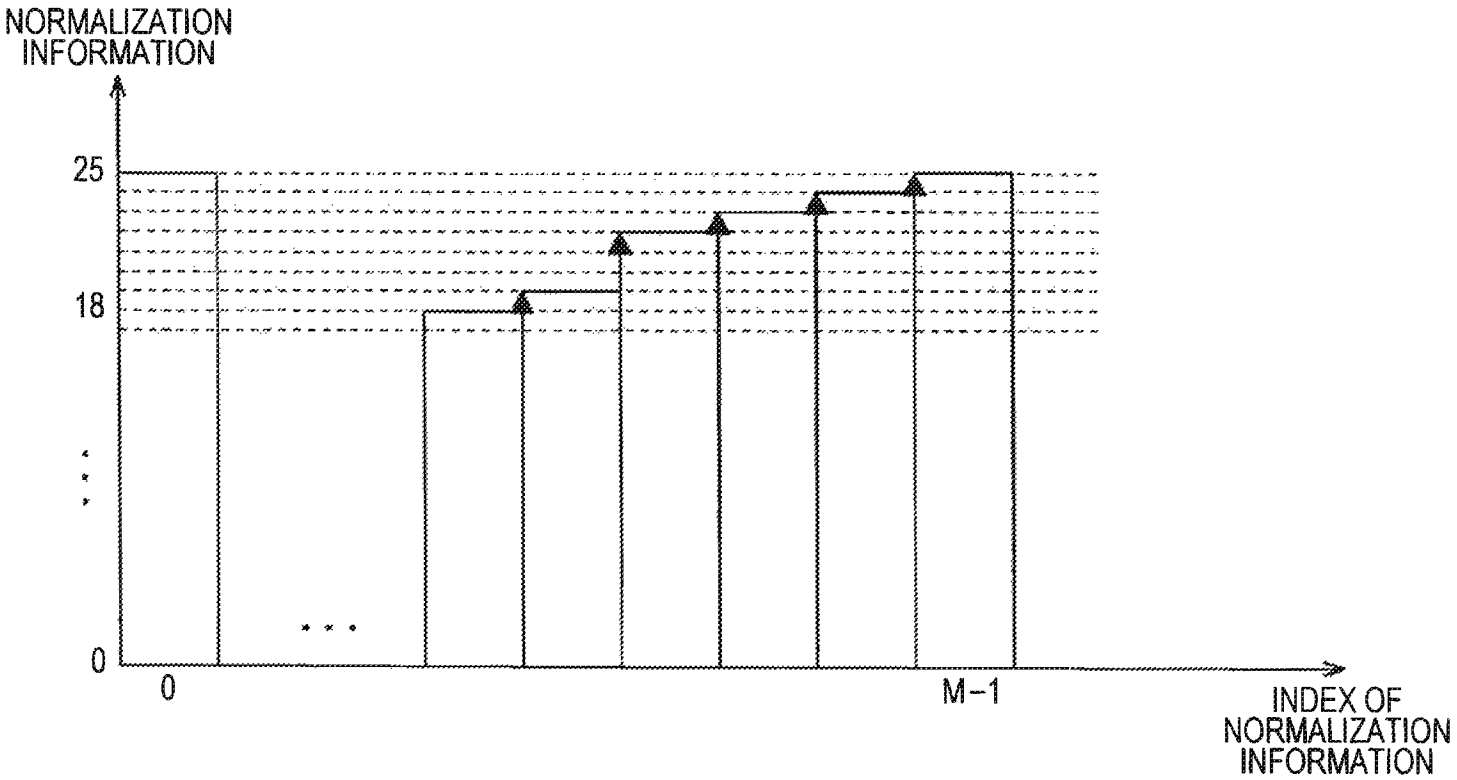
FIG. 25 is a diagram illustrating a third noise detection process performed on normalization information.

FIG. 25 is a diagram illustrating the third noise detection process performed on the normalization information idsf of the frequency spectra mdspec shown in FIG. 22. Note that, in FIG. 25, solid lines represent the normalization information idsf.

As shown in FIG. 25, in the example of the third noise detection process, when the normalization information idsf of the frequency spectra mdspec out of the audio band is monotonically increased, the noise unique to a PDM signal is detected.

Note that in the second and third examples of the noise detection process, the determinations are made in accordance with the normalization information idsf. However, the plurality of normalization information idsf may be divided into groups and determination may be made in accordance with the normalization information idsf for individual groups.

Furthermore, the noise detection process performed by the noise detector 201 may be one of the first to third examples or may be a combination of the first to third examples. Furthermore, the noise detection process performed by the noise detector 201 is not limited to the first to third examples described above.

Gain Control

Figure 26:
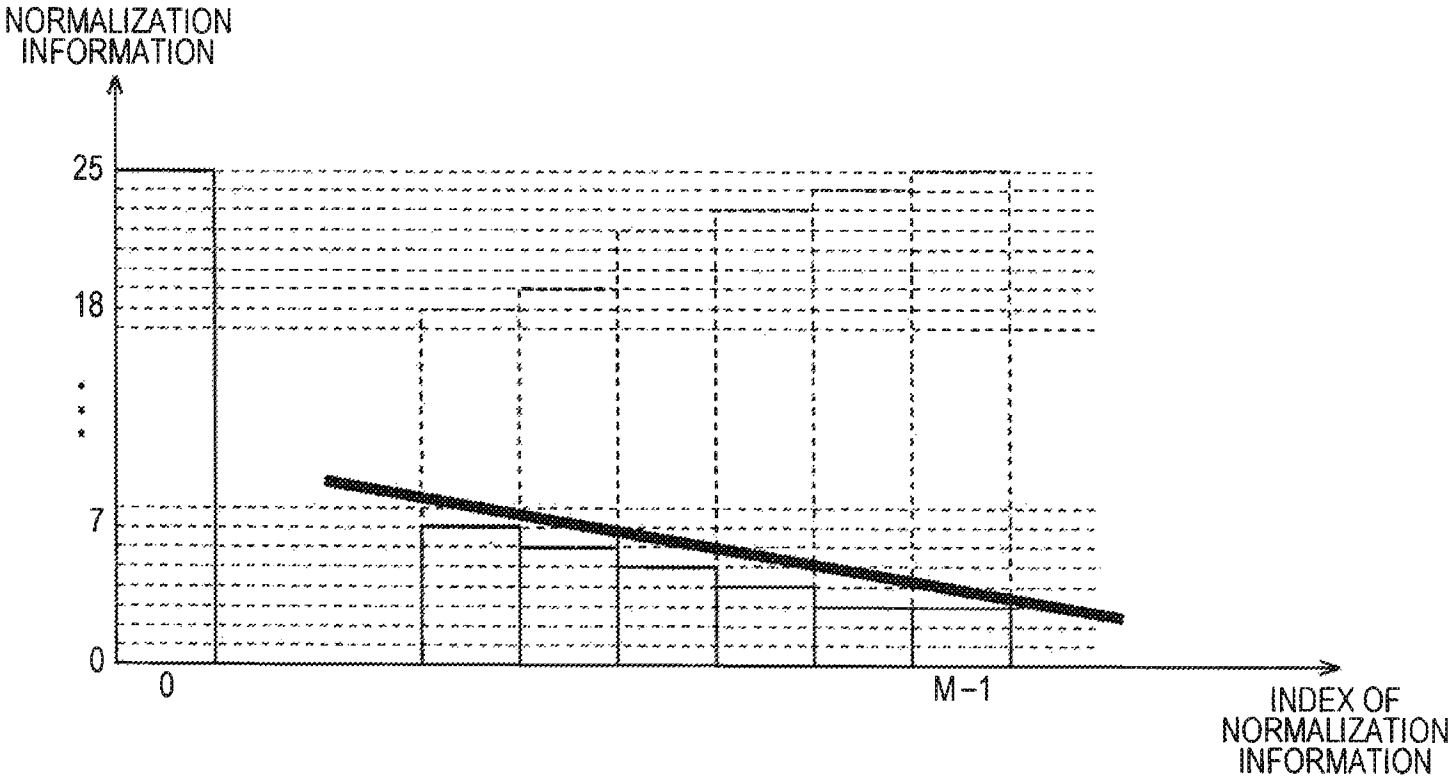
FIG. 26 is a diagram illustrating gain control performed on normalization information.

FIG. 26 is a diagram illustrating the gain control performed by the gain controller 202 on the normalization information idsf of the frequency spectra mdspec shown in FIG. 22. Note that, in FIG. 26, an axis of abscissa denotes an index of normalization information and an axis of ordinate denotes normalization information. Furthermore, in FIG. 26, dotted lines represent the normalization information idsf which has not been subjected to the gain control, solid lines represent normalization information idsf' obtained through the gain control, and a bold line represents inclination of the gain control.

As shown in FIG. 26, in the gain control performed by the gain controller 202, gains of the normalization information idsf are controlled so that the normalization information idsf of the frequency spectra mdspec out of the audio band are monotonically reduced with certain inclination.

Note that the gain control performed by the gain controller 202 is not limited to the example shown in FIG. 26.

Process of Audio Encoding Apparatus

Figure 27:
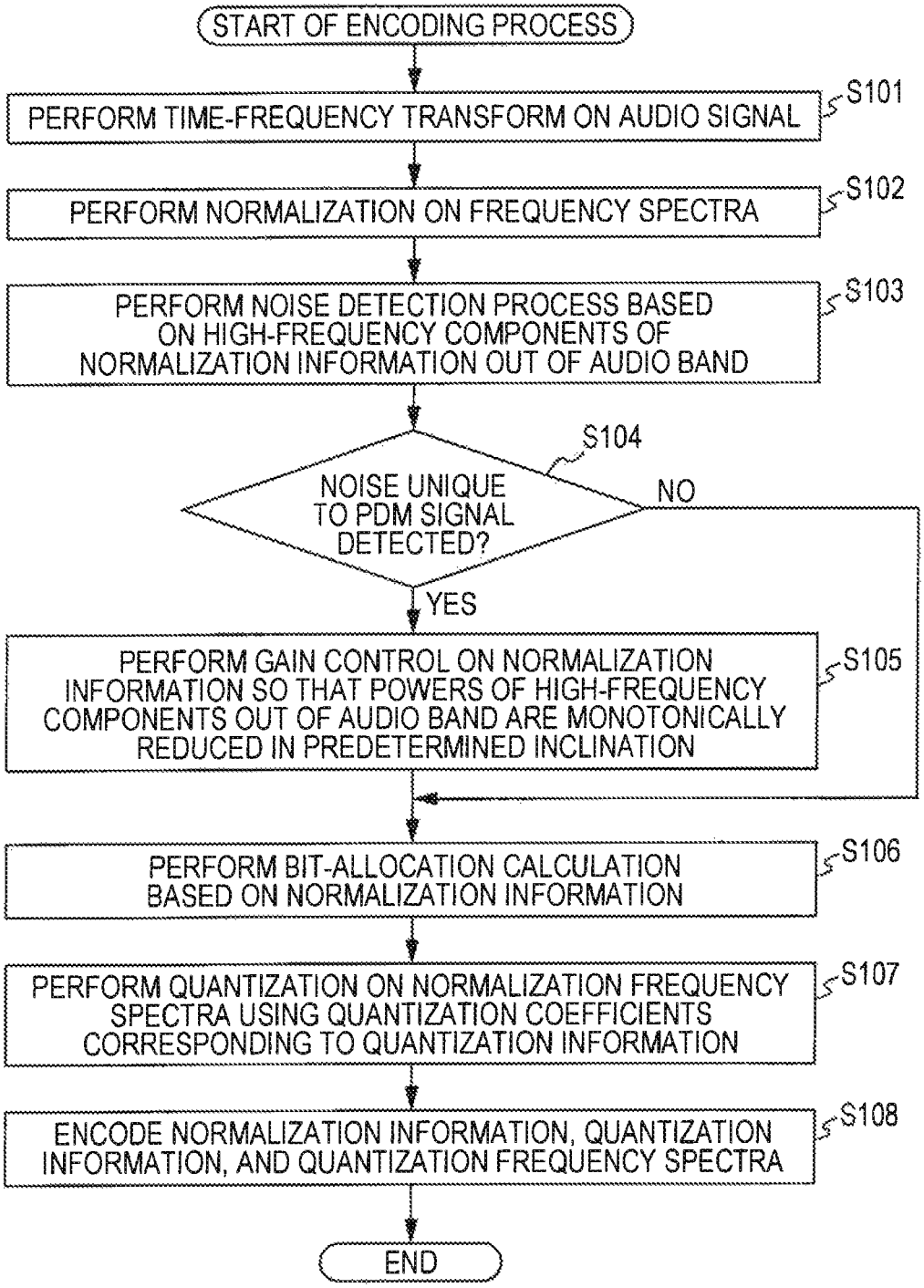
FIG. 27 is a flowchart illustrating an encoding process performed by the audio encoding apparatus shown in FIG. 21.

FIG. 27 is a flowchart illustrating an encoding process performed by the audio encoding apparatus 200 shown in FIG. 21. The encoding process is started when an audio signal which is a time-series signal is supplied to the audio encoding apparatus 200.

In step S101 of FIG. 27, the time-frequency transform unit 11 performs time-frequency transform on the audio signal input as the time-series signal and outputs resultant frequency spectra mdspec.

In step S102, the normalization unit 12 performs normalization on the frequency spectra mdspec supplied from the time-frequency transform unit 11 for each predetermined processing unit using normalization coefficients sf(idsf) corresponding to amplitudes of the frequency spectra mdspec. The normalization unit 12 outputs normalization information idsf corresponding to the normalization coefficients sf(idsf) and normalization frequency spectra nspec obtained as a result of the normalization.

In step S103, the noise detector 201 performs the noise detection process described with reference to FIGS. 22 to 25 in accordance with high-frequency components out of the audio band of the normalization information idsf supplied from the normalization unit 12 so as to output a control signal c.

In step S104, the gain controller 202 determines whether noise unique to a PDM signal has been detected through the noise detection process performed in step S103 in accordance with the control signal c supplied from the noise detector 201. When the control signal c represents detection of noise, it is determined that the noise unique to a PDM signal has been detected in step S103, and the process proceeds to step S105.

In step S105, the gain controller 202 performs the gain control described with reference to FIG. 26 on the normalization information idsf output from the normalization unit 12 so that the high-frequency components out of the audio band are monotonically reduced with certain inclination. Then, the gain controller 202 outputs normalization information idsf' obtained after the gain control, and the process proceeds to step S106.

On the other hand, when the control signal c represents that the noise has not been detected, it is determined that the noise unique to a PDM signal has not been detected in step S104 and the gain controller 202 outputs the normalization information idsf as normalization information idsf' without change. Then, the process proceeds to step S106.

In step S106, the bit allocation calculation unit 13 performs bit allocation calculation for each predetermined processing unit in accordance with the normalization information idsf' supplied from the gain controller 202 and supplies quantization information idwl to a code-string encoder 15. Furthermore, the bit allocation calculation unit 13 outputs the normalization information idsf' supplied from the gain controller 202 to the code-string encoder 15.

The process from step S107 and step S108 is the same as the process from step S15 and step S16 shown in FIG. 8, and therefore, a description thereof is omitted.

As described above, the audio encoding apparatus 200 performs the noise detection process in accordance with the normalization information of the audio signal before performing the bit allocation calculation. Furthermore, when the noise unique to a PDM signal is detected through the noise detection process, the normalization information is subjected to the gain control so that high frequency components out of the audio band of the normalization information attenuate. By this, the number of bits allocated to the noise unique to a PDM signal may be reduced and the number of bits allocated to the audio band which is important in terms of acoustic sense may be increased. As a result, high-accuracy encoding may be performed on a multi-bit PCM signal generated from a PDM signal including the noise unique to a PDM signal. Accordingly, a high-quality multi-bit PCM signal may be recorded and transmitted with high quality.

Furthermore, since the audio encoding apparatus 200 performs the noise detection process and the gain control using the normalization information idsf obtained by the normalization unit 12, as with the audio encoding apparatus 150, the number of modules to be added to the general audio encoding apparatus 10 may be reduced when compared with the audio encoding apparatus 50. Accordingly, the audio encoding apparatus 200 may be easily obtained by converting the general audio encoding apparatus 10.

Furthermore, since the audio encoding apparatus 200 performs the noise detection process and the gain control in the course of the encoding process, processing delay may be reduced when compared with the audio encoding apparatus 50.

Furthermore, since the normalization information idsf is integer numbers, the audio encoding apparatus 200 may perform the noise detection process and the gain control with the small number of calculations when compared with the audio encoding apparatus 150 which performs the noise detection process and the gain control using the frequency spectra which are real numbers. On the other hand, since the audio encoding apparatus 150 performs the noise detection process and the gain control using the frequency spectra mdspec, the audio encoding apparatus 150 may perform encoding with higher accuracy when compared with the audio encoding apparatus 200.

Example of Configuration of Audio Decoding Apparatus

Figure 28:
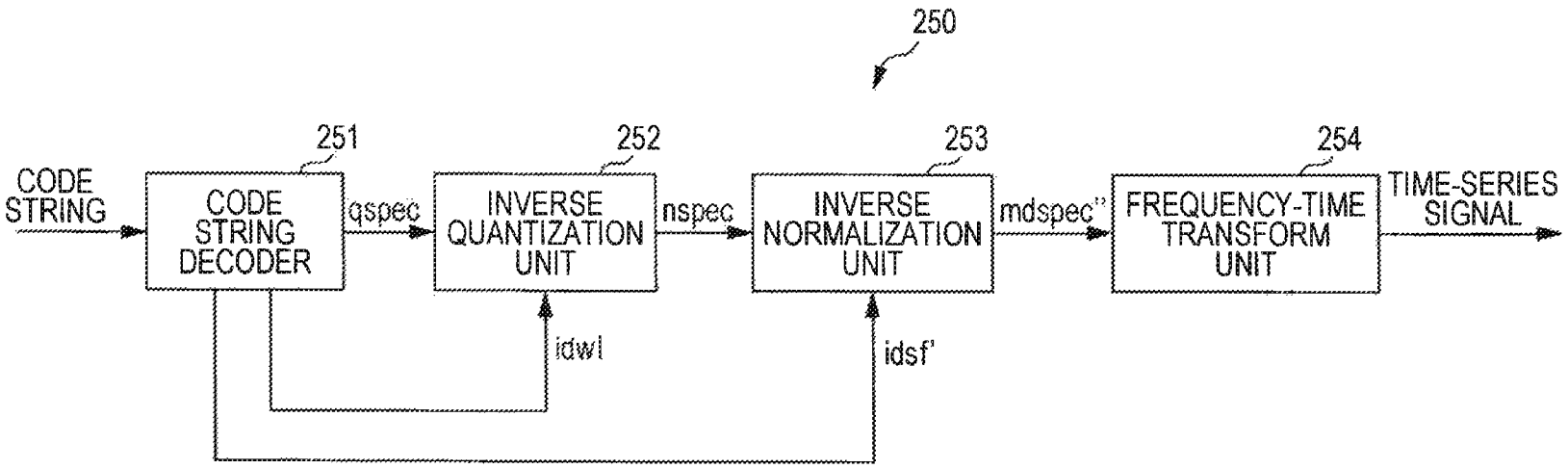
FIG. 28 is a block diagram illustrating a configuration of a decoding apparatus.

FIG. 28 is a block diagram illustrating a configuration of an audio decoding apparatus 250 which decodes a code string encoded by the audio encoding apparatus 200 shown in FIG. 21.

The audio decoding apparatus 250 shown in FIG. 28 includes a code-string decoding unit 251, an inverse quantization unit 252, an inverse normalization unit 253, and a frequency-time transform unit 254. The audio decoding apparatus 250 decodes a code string supplied from the audio encoding apparatus 200 so as to obtain an audio signal which is a time-series signal.

Specifically, the code-string decoding unit 251 of the audio decoding apparatus 250 performs decoding on the code string supplied from the audio encoding apparatus 200 so as to obtain normalization information idsf', quantization information idwl, and quantization frequency spectra qspec to be output.

The inverse quantization unit 252 performs quantization on the quantization frequency spectra qspec supplied from the code-string decoding unit 251 for each processing unit using inverse quantization coefficients corresponding to the quantization information idwl supplied from the bit allocation calculation unit 251. The inverse quantization unit 252 outputs normalization frequency spectra nspec obtained as a result of the inverse quantization.

The inverse normalization unit 253 performs inverse normalization on the normalization frequency spectra nspec supplied from the inverse quantization unit 252 for each processing unit using inverse normalization coefficients corresponding to the normalization information idsf' supplied from the code-string decoding unit 251. The inverse normalization unit 253 outputs frequency spectra mdspec" obtained as a result of the inverse normalization.

The frequency-time transform unit 254 performs frequency-time transform on the frequency spectra mdspec" supplied from the inverse normalization unit 253 and outputs an audio signal which is a time-series signal obtained as a result of the frequency-time transform. For example, the frequency-time transform unit 254 performs frequency-time transform by inverse orthogonal transform such as IMDCT on N MDCT coefficients serving as the frequency spectra mdspec" and outputs a time-series signal of 2N samples.

Inverse Normalization

Figure 29:
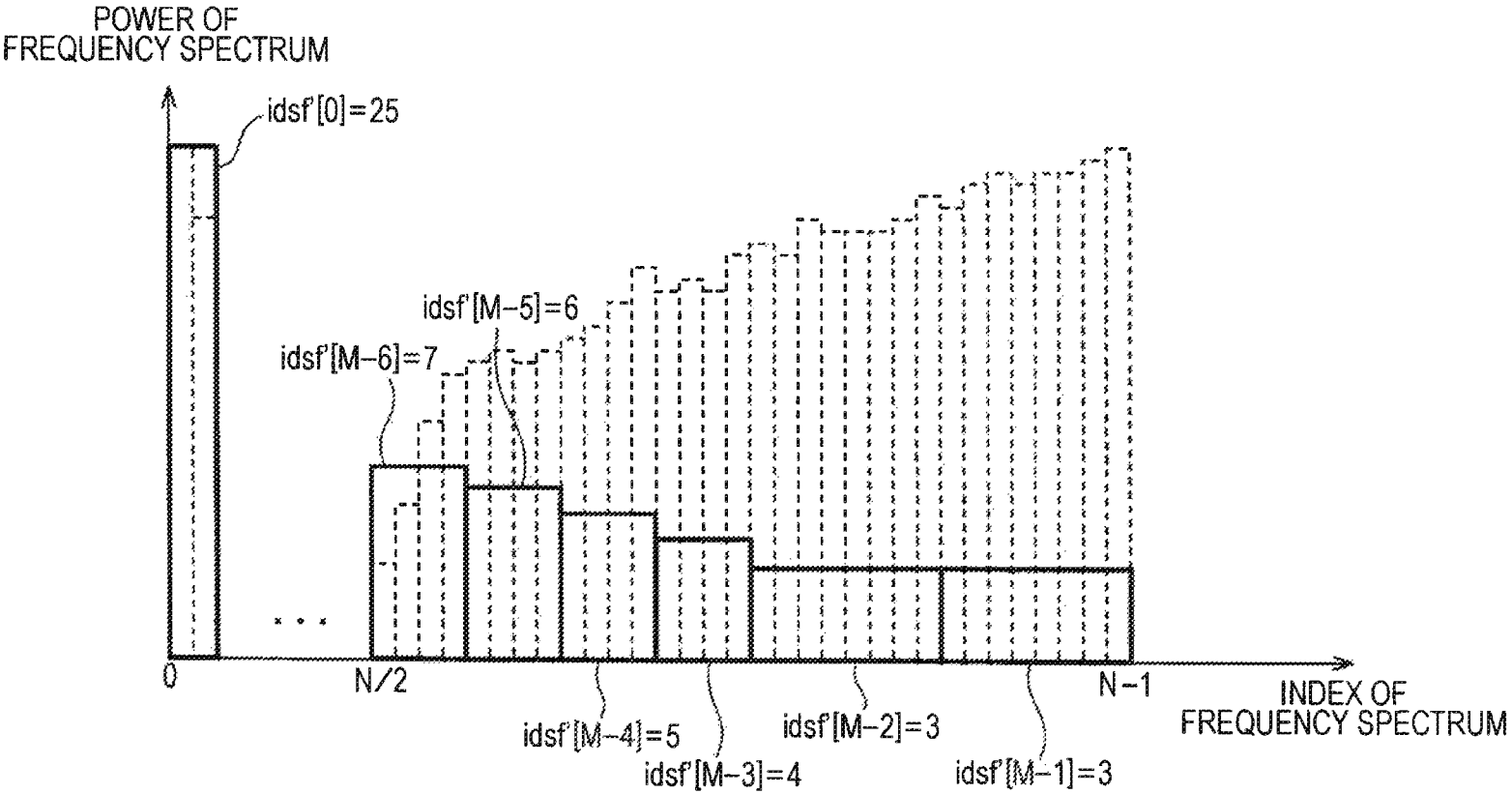
FIG. 29 is a diagram illustrating normalization information.
Figure 30:
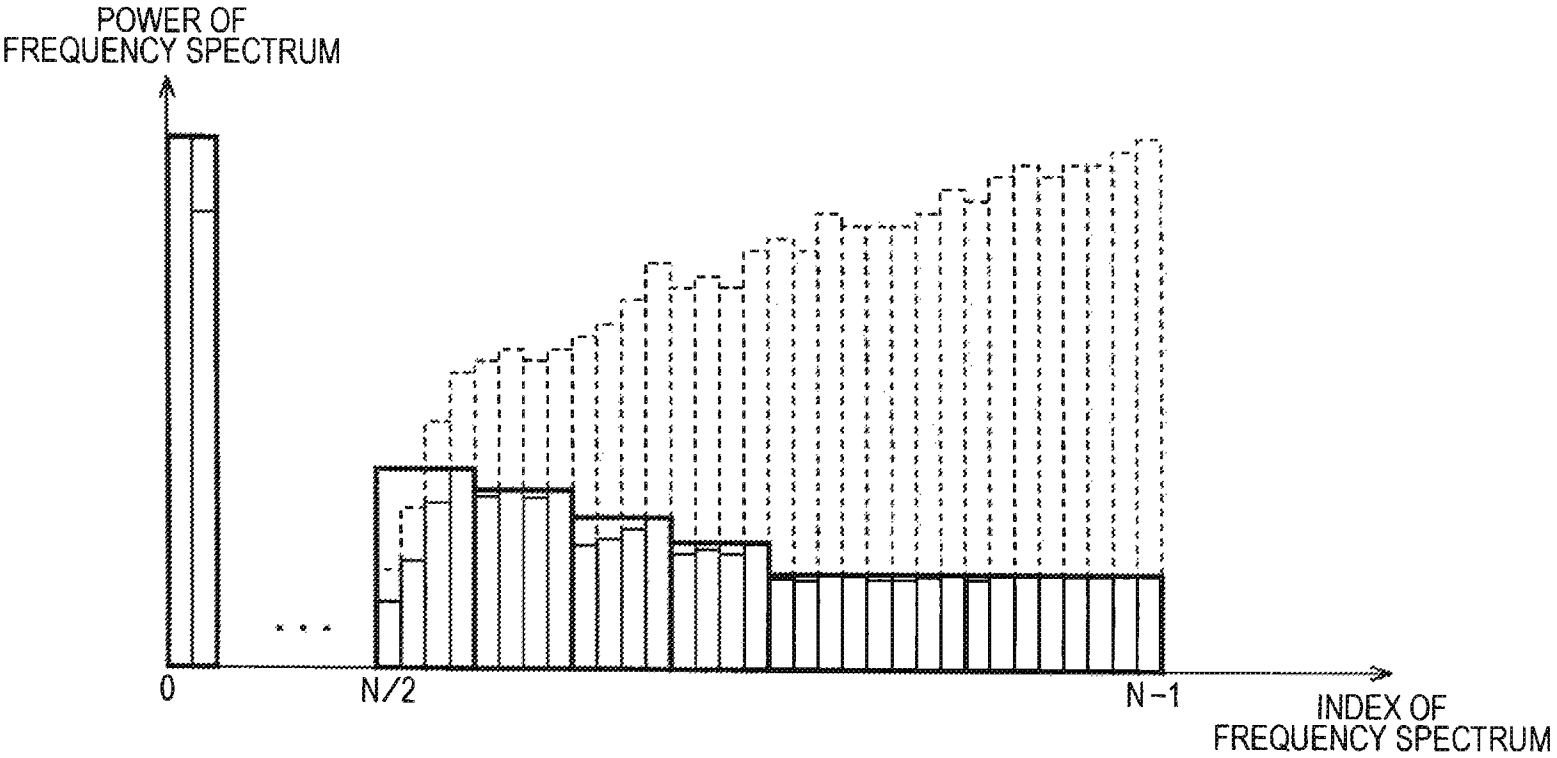
FIG. 30 is a diagram illustrating frequency spectra obtained as a result of inverse normalization.

FIGS. 29 and 30 are diagrams illustrating the inverse normalization performed by the inverse normalization unit 253. Note that, in FIGS. 29 and 30, an axis of abscissa denotes an index of a frequency spectrum and an axis of ordinate denotes a power of the frequency spectrum.

FIG. 29 is a diagram illustrating the normalization information idsf' supplied to the inverse normalization unit 253. Note that, in FIG. 29, dotted lines represent the frequency spectra mdspec of the audio signal supplied to the audio encoding apparatus 200 and bold lines represent powers of frequency spectra for each quantization unit corresponding to the normalization information idsf'.

In FIG. 29, the normalization information idsf' is obtained when the code-string decoding unit 251 restores the normalization information idsf' which has been subjected to the gain control described with reference to FIG. 26.

FIG. 30 is a diagram illustrating the frequency spectra mdspec" obtained as a result of the inverse normalization performed on the normalization information idsf' shown in FIG. 29. Note that, in FIG. 30, dotted lines represent the frequency spectra mdspec of the audio signal supplied to the audio encoding apparatus 200 and solid lines represent the frequency spectra mdspec" output from the inverse normalization unit 253.

As shown in FIG. 30, powers of the frequency spectra for each quantization unit corresponding to the normalization information idsf' shown in FIG. 29 are changed for individual frequency spectra due to normalization frequency spectra nspec of the corresponding frequency spectra. Note that the powers of the frequency spectra mdspec" included in each quantization unit is limited within the powers of the frequency spectra corresponding to the normalization information idsf' of the quantization unit.

Accordingly, an effect of the gain control of the normalization information idsf in the audio encoding apparatus 200 is the same as an effect of the gain control performed for each quantization unit of the frequency spectra mdspec.

Process of Audio Decoding Apparatus

Figure 31:
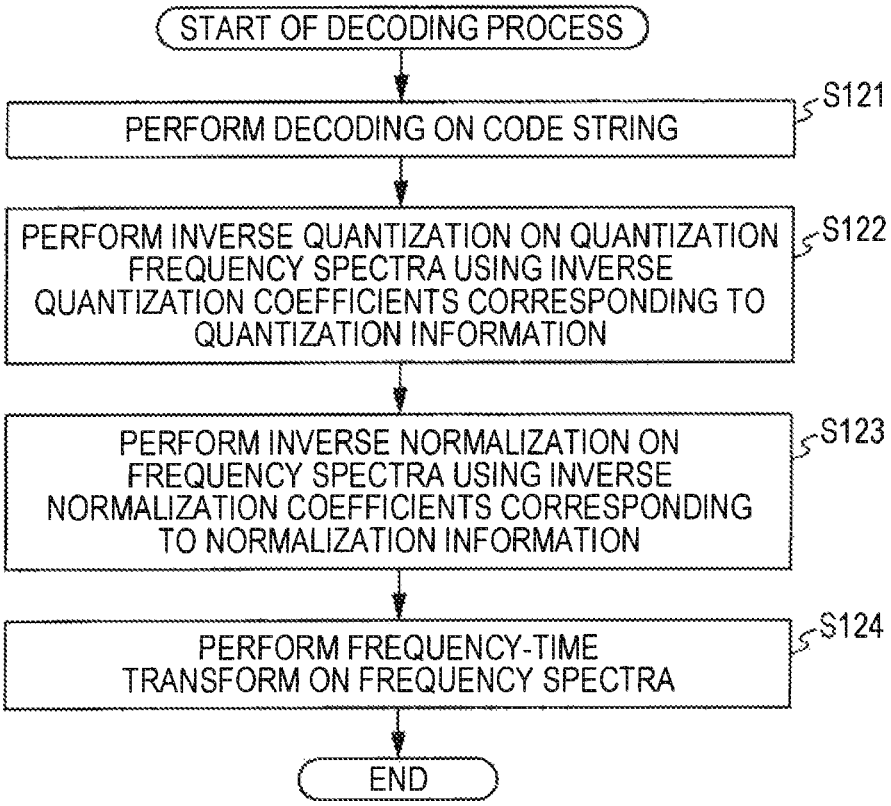
FIG. 31 is a flowchart illustrating a decoding process performed by the audio encoding apparatus shown in FIG. 28.

FIG. 31 is a flowchart illustrating a decoding process performed by the audio encoding apparatus 250 shown in FIG. 28. The decoding process is started when a code string output from the audio encoding apparatus 200 is supplied to the audio decoding apparatus 250.

In step S121 of FIG. 31, the code-string decoding unit 251 of the audio decoding apparatus 250 performs decoding on the code string supplied from the audio encoding apparatus 200 so as to obtain normalization information idsf', quantization information idwl, and quantization frequency spectra qspec to be output.

In step S122, the inverse quantization unit 252 performs inverse quantization on the quantization frequency spectra qspec supplied from the code-string decoding unit 251 for each processing unit using inverse quantization coefficients corresponding to the quantization information idwl supplied from the code-string decoding unit 251. The inverse quantization unit 252 outputs normalization frequency spectra nspec obtained as a result of the inverse quantization.

In step S123, the inverse normalization unit 253 performs inverse normalization on the normalization frequency spectra nspec supplied from the inverse quantization unit 252 for each processing unit using inverse normalization coefficients corresponding to the normalization information idsf' supplied from the code-string decoding unit 251. The inverse normalization unit 253 outputs frequency spectra mdspec" obtained as a result of the inverse normalization.

In step S124, the frequency-time transform unit 254 performs frequency-time transform on frequency spectra mdspec" supplied from the inverse normalization unit 253 and outputs an audio signal which is a time-series signal obtained as a result of the frequency-time transform. Then, the process is terminated.

As described above, the audio decoding apparatus 250 decodes the code string supplied from the audio encoding apparatus 200 and performs the inverse normalization on the normalization frequency spectra nspec using the inverse normalization coefficients corresponding to the normalization information idsf' obtained as a result of the decoding. By this, when the normalization information idsf' corresponds to attenuated high-frequency components out of the audio band, the frequency spectra mdspec" having attenuated high-frequency components out of the audio band may be obtained as a result of inverse normalization. As a result, a high-accuracy multi-bit PCM signal in which high-frequency components out of the audio band including noise unique to a PDM signal are attenuated may be output.

Note that, although not shown, an audio decoding apparatus which decodes a code string output from the audio encoding apparatuses 50 and 150 is configured similarly to the audio decoding apparatus 250 and performs similar processes. Consequently, when the audio encoding apparatus 50(150) detects noise unique to a PDM signal, frequency spectra in which high-frequency components out of the audio band are attenuated may be obtained similarly to the audio decoding apparatus 250.

Furthermore, although a sampling frequency of an input audio signal is 96 kHz in the examples shown in FIGS. 11 and 22, the sampling frequency is not limited to this and the number of frequency spectra of high-frequency components out of the audio band is also not limited to N/2. For example, the sampling frequency may be 192 kHz. In this case, among N frequency spectra having indices 0 to N−1, 3N/4 frequency spectra having the indices N/4 to N−1 correspond to frequency spectra of high-frequency components out of the audio band.

Furthermore, although the noise unique to a PDM signal is detected in this embodiment, the noise detector may detect other noise as long as noise is included in a predetermined band. In this case, the band to be subjected to the gain control includes noise to be detected by the noise detector.

Fourth Embodiment

Computer to which Technology is Applied

Next, the series of processes described above may be performed by hardware or software. When the series of processes is performed by software, programs included in the software are installed in a general-purpose computer or the like.

Figure 32:
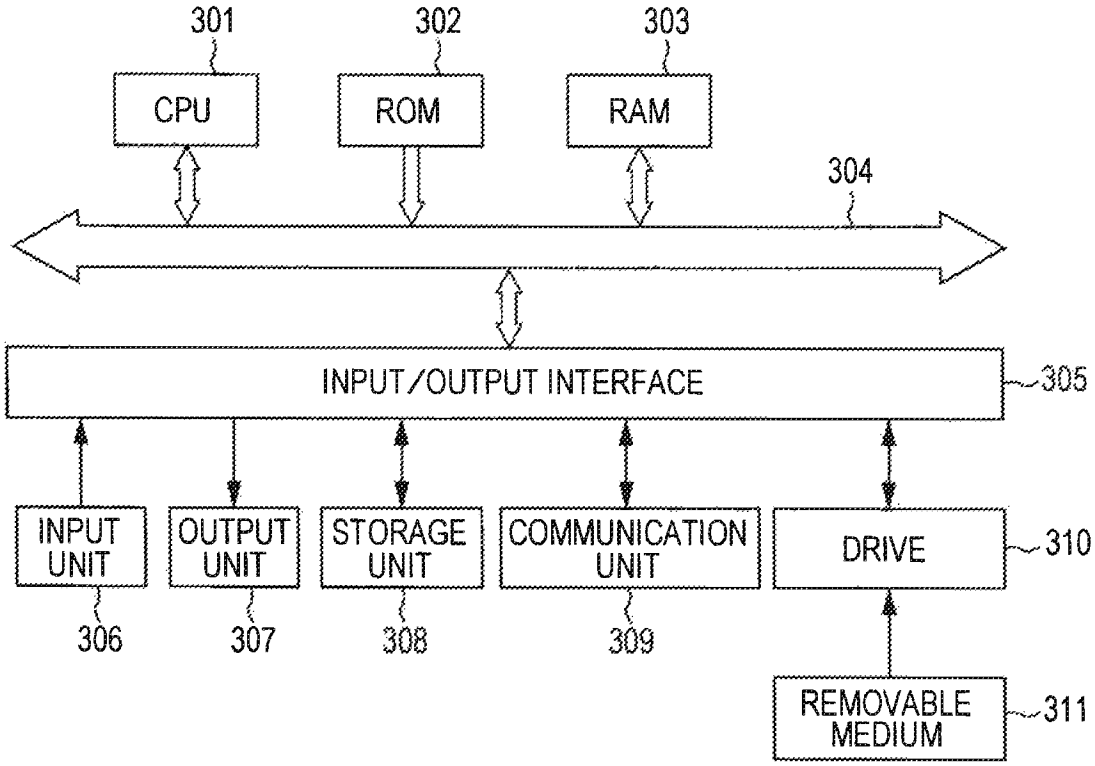
FIG. 32 is a diagram illustrating a configuration of a computer according to an embodiment.

Then, FIG. 32 illustrates a configuration of a computer to which the programs used to execute the series of processes described above are installed according to an embodiment.

The programs may be stored in a storage unit 308 or a ROM (Read Only Memory) 302 serving as a recording medium incorporated in the computer.

Alternatively, the programs may be stored (recorded) in a removable medium 311. The removable medium 311 may be provided as package software. Here, examples of the removable medium 311 include a flexible disk, a CD-ROM (Compact Disc Read Only Memory), an MO (Magneto Optical) disc, a DVD (Digital Versatile Disc), a magnetic disk, and a semiconductor memory.

Note that the programs may be installed in the computer from the removable medium 311 through a drive 310 or may be downloaded to the computer through a communication network or a broadcast network and installed in the incorporated storage unit 308. Specifically, the programs may be transferred from a downloading site to the computer through an artificial satellite for a digital satellite broadcast in a wireless manner or through a network such as a LAN (Local Area Network) or the Internet in a wired manner.

The computer includes a CPU (Central Processing Unit) 301 and the CPU 301 is connected to an input/output interface 305 through a bus 304.

When the user inputs an instruction by operating an input unit 306 through the input/output interface 305, the CPU 301 executes the programs stored in the ROM 302 in accordance with the instruction. Alternatively, the CPU 301 loads the programs stored in the storage unit 308 in a RAM (Random Access Memory) 303 and executes the programs.

By this, the CPU 301 performs the processes in accordance with the flowcharts described above or the processes performed by the configurations in the block diagrams described above. Then, the CPU 301 outputs results of the processes from an output unit 307 through the input/output interface 305, transmits results of the processes from a communication unit 309, or causes the storage unit 308 to store results of the processes.

Note that the input unit 306 includes a keyboard, a mouse, and a microphone. Furthermore, the output unit 307 includes an LCD (Liquid Crystal Display) and a speaker.

Here, in this specification, it is not necessarily the case that the processes are performed by the computer in accordance with the programs in time series in the order described in the flowcharts. Specifically, the processes may be performed by the computer in accordance with the programs in parallel or individually (for example, a parallel process or a process using an object).

Furthermore, the programs may be processed by a single computer (processor) or may be processed by a plurality of computers in a distribution manner. Furthermore, the programs may be transferred to a remote computer which executes the programs.

Embodiments of the present disclosure are not limited to the foregoing embodiments and various modifications may be made without departing from the scope of the present disclosure.

What is claimed is:

1. A decoding apparatus comprising:

circuitry configured to perform decoding of an encoded code string including normalization information and quantized frequency spectra, wherein when noise induced in a certain band in accordance with an audio signal and sums of powers of groups of the frequency spectra in the certain band are monotonically increased are detected, components in the certain band of the audio signal are attenuated and the frequency spectra including the attenuated components in the certain band of the audio signal are normalized with normalization information and quantized;

perform inverse quantization on the quantized frequency spectra to generate normalization frequency spectra; and perform inverse normalization on the normalization frequency spectra with the normalization information to generate frequency spectra.

2. A decoding method comprising:

decoding an encoded code string including normalization information and quantized frequency spectra, wherein when noise induced in a certain band in accordance with an audio signal and sums of powers of groups of the frequency spectra in the certain band are monotonically increased are detected, components in the certain band of the audio signal are attenuated and the frequency spectra including the attenuated components in the certain band of the audio signal are normalized with normalization information and quantized;

inverse quantizing the quantized frequency spectra to generate normalization frequency spectra; and inverse normalizing the normalization frequency spectra with the normalization information to generate frequency spectra.

3. A non-transitory computer-readable medium having embodied thereon a program, which when executed by a computer causes the computer to execute a method, the method comprising:

decoding an encoded code string including normalization information and quantized frequency spectra, wherein when noise induced in a certain band in accordance with an audio signal and sums of powers of groups of the frequency spectra in the certain band are monotonically increased are detected, components in the certain band of the audio signal are attenuated and the frequency spectra including the attenuated components in the certain band of the audio signal are normalized with normalization information and quantized;

inverse quantizing the quantized frequency spectra to generate normalization frequency spectra; and inverse normalizing the normalization frequency spectra with the normalization information to generate frequency spectra.

* * * * *